US010639912B2

(12) United States Patent
Uesaka et al.

(10) Patent No.: US 10,639,912 B2
(45) Date of Patent: May 5, 2020

(54) EJECTION DEVICE

(71) Applicant: FUJI XEROX CO., LTD., Tokyo (JP)

(72) Inventors: Tomozumi Uesaka, Ebina (JP); Masahiko Sekimoto, Ebina (JP); Hiroshi Ikeda, Ebina (JP); Hiroshi Inoue, Ebina (JP); Norihisa Takemoto, Ebina (JP); Satoshi Hasebe, Ebina (JP); Takeshi Zengo, Ebina (JP); Yukari Motosugi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/051,637

(22) Filed: Aug. 1, 2018

(65) Prior Publication Data

US 2019/0091993 A1 Mar. 28, 2019

(30) Foreign Application Priority Data

Sep. 26, 2017 (JP) ..... 2017-185241
Feb. 16, 2018 (JP) ..... 2018-026325

(51) Int. Cl.
*B41J 11/00* (2006.01)

(52) U.S. Cl.
CPC ..... *B41J 11/002* (2013.01); *B41J 11/0005* (2013.01); *B41J 11/0015* (2013.01)

(58) Field of Classification Search
CPC .... B41J 11/002; B41J 11/0015; B41J 11/0005
See application file for complete search history.

(56) References Cited

U.S. PATENT DOCUMENTS

2017/0266991 A1* 9/2017 Onodera ..... B41J 11/002

FOREIGN PATENT DOCUMENTS

JP 2013-28022 2/2013
JP 2014-108566 6/2014

OTHER PUBLICATIONS

Abstract and machine translation of JP 2013-28022.
Abstract and machine translation of JP 2014-108566.

* cited by examiner

*Primary Examiner* — Geoffrey S Mruk
(74) *Attorney, Agent, or Firm* — Fildes & Outland, P.C.

(57) ABSTRACT

An ejection device includes: an ejection portion that ejects liquid droplets onto one surface of a recording medium that is fed; a first drying portion that applies light energy to the one surface in a noncontact manner to thereby dry the liquid droplets; and a second drying portion that comes in contact with only other surface of the recording medium in which the liquid droplets have been dried toy the first drying portion, and heats the recording medium to thereby dry the recording medium.

17 Claims, 23 Drawing Sheets

FIG. 9

| ABSENCE OF EVAPORATION PROMOTING CHAMBER | | | | |
|---|---|---|---|---|
| DISTANCE OF SECOND FEEDING PATH (mm) | 1000 | 1500 | 2000 | 2500 |
| FEEDING TIME IN SECOND FEEDING PATH (sec) | 1.2 | 1.8 | 2.4 | 3 |
| MOISTURE CONTENT JUST BEFORE DRYING DRUM (%) | 11.2 | 10.7 | 10.4 | 10 |
| GENERATION OF WRINKLES | YES | YES | YES | NO |

| PRESENCE OF EVAPORATION PROMOTING CHAMBER | | | | |
|---|---|---|---|---|
| DISTANCE OF SECOND FEEDING PATH (mm) | 1000 | 1500 | 2000 | 2500 |
| FEEDING TIME IN SECOND FEEDING PATH (sec) | 1.2 | 1.8 | 2.4 | 3 |
| MOISTURE CONTENT JUST BEFORE DRYING DRUM (%) | 10.5 | 10 | 9.7 | 9.2 |
| GENERATION OF WRINKLES | YES | NO | NO | NO |

EJECTION DEVICE

CROSS-REFERENCE TO RELATED APPLICATIONS

This application is based on and claims priority under 35 USC 119 from Japanese Patent Application No. 2017-185241 filed on Sep. 26, 2017 and Japanese Patent Application No. 2018-026325 filed on Feb. 16, 2018.

BACKGROUND

1. Technical Field

The present invention relates to an ejection device.

2. Related Art

JP-A-2013-28022 discloses an inkjet printer including a noncontact drying unit that performs a primary drying treatment on a printed surface of a recording medium, and a contact drying unit including a wrinkle removing unit that performs a secondary drying treatment on the printed surface of the recording medium subjected to the primary drying treatment, so as to remove wrinkles generated in the recording medium. The contact drying unit is constituted by a heat roller and a pressure roller so that the drying treatment can be performed on the recording medium held between the heat roller and the pressure roller.

SUMMARY

Here, in a configuration including a first drying portion that applies light energy to one surface of a recording medium in a noncontact manner to thereby dry liquid droplets, and a second drying portion that dries the recording medium in which the liquid droplets have been dried by the first drying portion, wrinkles may be generated in the recording medium when the recording medium is dried by the second drying portion holding the recording medium from one surface and the other surface thereof.

Aspects of non-limiting embodiments of the present disclosure relate to an ejection device including a first drying portion that applies light energy to one surface of a recording medium in a noncontact manner to thereby dry liquid droplets, and a second drying portion that dries the recording medium in which the liquid droplets have been dried by the first drying portion, so that generation of wrinkles in the recording medium can be suppressed in comparison with the configuration in which the recording medium is dried by the second drying portion holding the recording medium from one surface and the other surface thereof.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

An aspect of the present invention is an ejection device including: an ejection portion that ejects liquid droplets onto one surface of a recording medium that is fed; a first drying portion that applies light energy to the one surface in a noncontact manner to thereby dry the liquid droplets; and a second drying portion that comes in contact with only the other surface of the recording medium in which the liquid droplets have been dried by the first drying portion, and heats the recording medium to thereby dry the recording medium.

BRIEF DESCRIPTION OF THE DRAWINGS

Exemplary embodiments of the present invention will be described in detail based on the following figures, wherein:

FIG. 9 is a table showing evaluation results;

DESCRIPTION OF REFERENCE NUMERALS AND SIGNS

Figure 1:
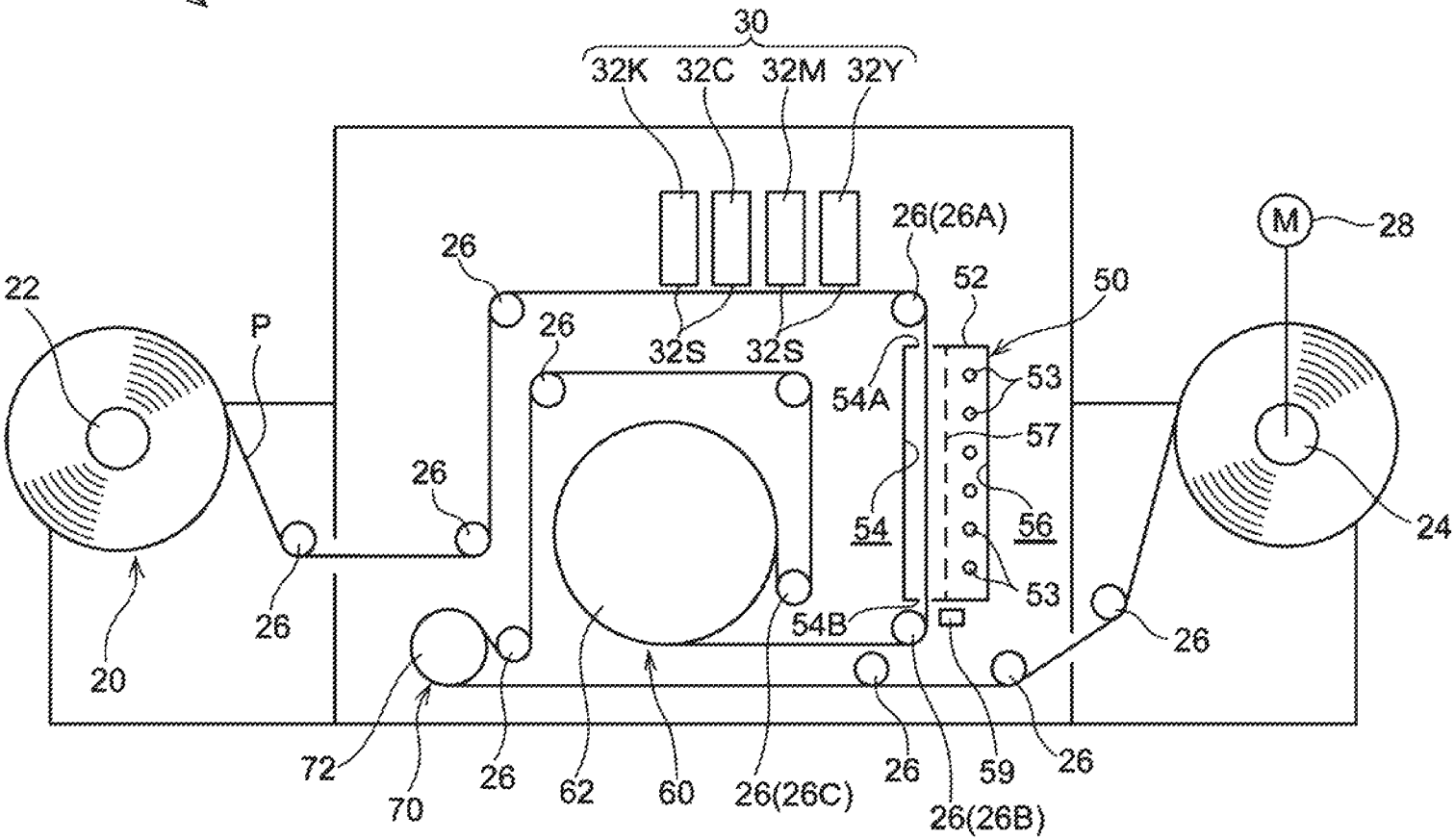
FIG. 1 is a schematic view illustrating a configuration of an inkjet recording apparatus according to a first exemplary embodiment.

10, 200, 300 inkjet recording apparatus (example of ejection device)
26B wind roll (example of contact member)
30 ejection unit (example of ejection portion)
50 first drying portion
55 air blower
60 second drying portion
202, 302 evaporation promoting chamber (example of promotion chamber)
306 air blower
311 first opposed wall (example of opposed wall)
312 second opposed wall (example of wall portion)
326 air blowing port
329 discharge port
338 outer edge
350 opening portion
360 partition plate
362 air flow passageway
366 gap
P continuous paper (example of recording medium)

DETAILED DESCRIPTION

Exemplary embodiments of the present invention will be described below with reference to the drawings by way of example.

First Exemplary Embodiment (Inkjet Recording Apparatus 10)

First, an inkjet recording apparatus 10 will be described. FIG. 1 is a schematic view illustrating the configuration of the inkjet recording apparatus 10.

The inkjet recording apparatus 10 is an example of an ejection device that ejects liquid droplets. Specifically, the inkjet recording apparatus 10 is an apparatus that ejects ink droplets onto a recording medium. More specifically, the inkjet recording apparatus 10 is an apparatus that ejects ink droplets onto continuous paper P (an example of a recording medium) to thereby form an image on the continuous paper P. To say other words, the inkjet recording apparatus 10 may be regarded as an image forming apparatus that forms an image on a recording medium.

As illustrated in FIG. 1, the inkjet recording apparatus 10 has a feed mechanism 20, an ejection unit 30 (an example of an ejection portion), a first drying portion 50, a second drying portion 60, and a cooling portion 70. Description will be made below about ink and the continuous paper P for use in the inkjet recording apparatus 10, the respective portions (the feed mechanism 20, the ejection unit 30, the first drying portion 50, the second drying portion 60, and the cooling portion 70) of the inkjet recording apparatus 10, and a feeding path for the continuous paper P.

(Ink)

For example, aqueous ink is used as the ink for use in the inkjet recording apparatus 10. The aqueous ink contains water, a coloring agent, and other additives. A pigment or a dye is, for example, used as the coloring agent.

The ink has a property of permeating the recording medium. Incidentally, any ink may be used as long as it has a property of permeating the recording medium.

(Continuous Paper P)

The continuous paper P for use in the inkjet recording apparatus 10 is a long recording medium having length in the feeding direction thereof. Paper is used for the continuous paper P. Examples of the paper may include coated paper, uncoated paper (plain paper), etc.

The recording medium has a property of being permeated by the ink. The recording medium may be a sheet (cut paper). Any medium may be used as long as it has a property of being permeated by the ink.

(Feed Mechanism 20)

The feed mechanism 20 is a mechanism that feeds the continuous paper P. Specifically, the feed mechanism 20 has an unwind roll 22, a take-up roll 24, and a plurality of wind rolls 26, as shown in FIG. 1.

The unwind roll 22 is a roll that unwinds the continuous paper P. The continuous paper P is wound around the unwind roll 22 in advance. The unwind roll 22 rotates to unwind the wound continuous paper P.

The wind rolls 26 are rolls on which the continuous paper P is wound. Specifically, the continuous paper P is wound on the wind rolls 26 between the unwind roll 22 and the take-up roll 24. Thus, a feeding path of the continuous paper P from the unwind roll 22 to the take-up roll 24 is determined. To say other words, the wind rolls 26 may be regarded as contact members coining in contact with the continuous paper P.

The take-up roll 24 is a roll that takes up the continuous paper P. The take-up roll 24 is rotationally driven by a driving portion 28. Thus, the take-up roll 24 takes up the continuous paper P and the unwind roll 22 unwinds the continuous paper P. When the continuous paper P is taken up by the take-up roll 24 and unwound by the unwind roll 22, the continuous paper P is fed. The wind rolls 26 are driven and rotated by the continuous paper P which is being fed. Incidentally, in the respective drawings, the feeding direction of the continuous paper P (which may be hereinafter referred to as "feeding direction" simply) is indicated by an arrow A if necessary.

In addition, the feeding rate of the continuous paper P is set within a range not higher than 100 m/min and not lower than 20 m/min. Further, in the exemplary embodiment, the feeding rate may be changed at intervals of 10 m/min.

(Ejection Unit 30)

The ejection unit 30 is an example of an ejection portion that ejects liquid droplets onto one surface of the recording medium which is fed. Specifically the ejection unit 30 is a unit that ejects ink droplets (an example of the liquid droplets) onto a surface (an example of the one surface) of the continuous paper P. More specifically, the ejection unit 30 has ejection heads 32Y, 32M, 32C and 32K (hereinafter referred to as 32Y to 32K) which eject ink droplets of respective colors, that is, yellow (Y), magenta (M), cyan (C) and black (K) respectively onto the surface of the continuous paper P, as shown in FIG. 1.

The surface of the continuous paper P onto which the ink droplets are ejected is a surface where an image is formed by the ink droplets adhering to the continuous paper P. Therefore, the surface will be referred to as "formation surface". The opposite surface to the formation surface will be referred to as "non-formation surface".

The ejection heads 32Y to 32K are disposed in this order toward the upstream side in the feeding direction of the continuous paper P. Each of the ejection heads 32Y to 32K has length in a widthwise direction of the continuous paper P (cross direction crossing the feeding direction of the continuous paper P). Each ejection head 32Y to 32K ejects ink droplets in a known system such as a thermal system or a piezoelectric system. Thus, an image is formed on the continuous paper P.

In the following description, a part on which ink droplets have been ejected to form an image in the continuous paper P will be referred to as "image portion". On the other hand, a part where no image has been formed in the continuous paper P will be referred to as "non-image portion".

(First Drying Portion 50)

The first drying portion 50 is an example of a first drying portion that applies light energy to one surface of the recording medium in a noncontact manner to thereby dry liquid droplets. Specifically, the first drying portion 50 is a drying unit that applies light energy to the formation surface of the continuous paper P, where ink droplets have been ejected from the ejection unit 30, in a noncontact manner to thereby dry the ink droplets in the image portion. More specifically, the first drying portion 50 is configured as follows.

The first drying portion 50 is disposed on the downstream side in the feeding direction with respect to the ejection unit 30. Accordingly, the continuous paper P where ink droplets have been ejected to form an image by the ejection unit 30 is fed to the first drying portion 50.

Further, the first drying portion 50 has a housing 52, and irradiation portions 53 disposed inside the housing 52. A passageway 54 through which the continuous paper P is fed and an arrangement region 56 where the irradiation portions 53 have been disposed are formed inside the housing 52.

The passageway 54 is formed to extend in the up/down direction in FIG. 1. In addition, the passageway 54 has an inlet 54A and an outlet 54B. The continuous paper P is introduced into the passageway 54 through the inlet 54A and discharged through the outlet 54B. A metal net 57 is disposed between the passageway 54 and the arrangement region 56. The metal net 57 has a function of suppressing the continuous paper P fed through the passageway 54 from coming in contact with the irradiation portions 53.

The continuous paper P is fed through the passageway 54 in a state where the formation surface of the continuous paper P is made to face the irradiation portions 53.

Each of the irradiation portions 53 is constituted by a lamp that irradiates the formation surface of the continuous paper P with light. The irradiation portions 53 are disposed along the passageway 54. To say other words, the irradiation portions 53 are disposed along the direction in which the continuous paper P is fed through the passageway 54.

The irradiation portions 53 irradiates the formation surface of the continuous paper P with light so that moisture of the ink droplets and moisture of the continuous paper P can be heated and evaporated (vaporized) due to the energy of the light. Thus, the ink droplets and the continuous paper P are dried up.

Specifically the irradiation portions 53 irradiate the formation surface with light of a wavelength in which an absorption rate in the ink droplets is higher than an absorption rate in the continuous paper P. More specifically the irradiation portions 53 irradiate the formation surface with infrared rays as the light. Further more specifically the irradiation portions 53 irradiate the formation surface with near-infrared rays. Still more specifically the irradiation portions 53 irradiate the formation surface with light of a wavelength which is, for example, within a range not shorter than 2 μm and not longer than 2.5 μm.

In this manner, in the first drying portion 50, the formation surface is irradiated with light of a wavelength in which the absorption rate in the ink droplets is higher than the absorption rate in the continuous paper P, so that more moisture may be evaporated from the image portion than from the non-image portion in the continuous paper P. To say other words, the continuous paper P is more dried in the image portion than in the non-image portion.

Outputs of the irradiation portions 53 are controlled based on the temperature of the continuous paper P detected by a temperature sensor 59 disposed on the downstream side (in a second feeding path which will be described later) in the feeding direction with respect to the first drying portion 50. For example, a detection sensor for detecting a radiation temperature in a noncontact manner is used as the temperature sensor 59.

Further, the first drying portion 50 may have a configuration in which the air is blown to the passageway 54 and the irradiation portions 53 inside the first drying portion 50 in order to remove the evaporated moisture and suppress the irradiation portions 53 from overheating.

(Second Drying Portion 60)

The second drying portion 60 is an example of a second drying portion that comes in contact with only the other surface of the recording medium in which the liquid droplets have been dried by the first drying portion, so as to heat the recording medium and dry the recording medium. Specifically the second drying portion 60 is a drying unit that comes in contact with only the non-formation surface of the continuous paper P in which the ink droplets have been dried by the first drying portion 50, so as to heat the continuous paper P and dry the continuous paper P.

More specifically the second drying portion 60 has a drying drum 62. The drying drum 62 is, for example, constituted by a cylindrical drum made of metal. In the second drying portion 60, the drum surface is heated by a heat source such as a halogen lamp disposed inside the drying drum 62.

The drying drum 62 is disposed on the downstream side in the feeding direction with respect to the first drying portion 50. The continuous paper P is wound around the drying drum 62 so as to bring the non-formation surface of the continuous paper P into contact with the outer circumferential surface of the drying drum 62.

In the second drying portion 60, a part of the continuous paper P in which the ink droplets have been dried by the first drying portion 50 is fed to the drying drum 62, and the non-formation surface in the part is heated by the drying drum 62. Thus, the continuous paper P is dried. The surface temperature of the drying drum 62 is, for example, set within a range not lower than 70° C. and not higher than 150° C.

In this manner, in the second drying portion 60, the drying drum 62 comes in contact with only the non-formation surface of the continuous paper P so as to heat the continuous paper P and dry the continuous paper P. To say other words, the second drying portion 60 does not have any contact member in contact with the formation surface of the continuous paper P. To say more other words, in the second drying portion 60, the continuous paper P is not held from both the formation surface and the non-formation surface of the continuous paper P. Further, to say more other words, in the second drying portion 60, the non-formation surface is not pressed against the drying drum 62.

(Cooling Portion 70)

The cooling portion 70 has a function of cooling the continuous paper P. Specifically the cooling portion 70 has a cooling roll 72 that comes in contact with the formation surface of the continuous paper P so as to cool the continuous paper P. The cooling roll 72 is disposed on the downstream side in the feeding direction with respect to the second drying portion 60. The continuous paper P is wound around the cooling roll 72 so as to bring the formation surface of the continuous paper P into contact with the outer circumferential surface of the cooling roll 72.

In the cooling portion 70, a part of the continuous paper P in which the continuous paper P has been dried by the second drying portion 60 is fed to the cooling roll 72, and the formation surface in the part is cooled by the cooling roll 72.

(First Feeding Path of Continuous Paper P)

The first feeding path is a feeding path from the ejection unit 30 to the first drying portion 50. Specifically, the first feeding path is a path between a position (start position) where ink droplets ejected from the ejection head 32Y of the ejection unit 30 are attached to the continuous paper P and the inlet 54A (end position) of the housing 52 of the first drying portion 50. The end position of the first feeding path may be grasped as a position where the continuous paper P is irradiated with light by the irradiation portion 53 which is disposed on the most upstream side in the second drying portion 60.

In the first feeding path, the continuous paper P is wound around one of the aforementioned wind rolls 26 (hereinafter referred to as 26A) so as to bring the non-formation surface of the continuous paper P into contact with the outer circumferential surface of the wind roll 26A.

As a result, in the first feeding path, the feeding direction of the continuous paper P (the direction in which the continuous paper P is fed) is changed between the ejection unit 30 and the first drying portion 50. Specifically, the feeding direction of the continuous paper P is changed from a first direction along ejection surfaces 32S of the ejection heads 32Y to 32K to a second direction going away from the ejection surfaces 32S in a direction crossing the ejection surfaces 32S. To say other words, the second direction may be regarded as a direction on the non-formation surface side with respect to the formation surface of the continuous paper P fed in the first direction.

Further, the first direction is also a direction in which the continuous paper P is discharged from the ejection unit 30. On the other hand, the second direction is a direction in which the continuous paper P enters the first drying portion 50. Accordingly, in the first feeding path, the direction in which the continuous paper P is discharged from the ejection unit 30 is different from the direction in which the continuous paper P enters the first drying portion 50.

The first feeding path between the ejection unit 30 and the first drying portion 50 is set at a such a length that, within a set range of the feeding rate set by the feed mechanism 20, the image portion of the continuous paper P can be fed to the first drying portion 50 before the ink droplets ejected from the ejection unit 30 permeate the inside of the continuous paper P completely.

To say other words, the first feeding path is set at such a length that, within the set range of the feeding rate set by the feed mechanism 20, the image portion can be fed to the first drying portion 50 in a state where the ink droplets ejected from the ejection unit 30 still remain in the formation surface of the continuous paper P.

In this manner, the length of the first feeding path is set in order to allow the ink droplets to absorb the light with which the ink droplets are irradiated by the first drying portion 50 so that more moisture may be evaporated from the ink droplets. From this viewpoint, it is desired that the length of the first feeding path is as short as possible.

(Second Feeding Path of Continuous Paper P)

The second feeding path is a feeding path from the first drying portion 50 to the second drying portion 60. Specifically, the second feeding path is a path between the outlet 54B (start position) of the housing 52 of the first drying portion 50 and a position (end position) where the continuous paper P begins to come in contact with the drying drum 62 of the second drying portion 60. The start position of the second feeding path may be grasped as a position where the continuous paper P is irradiated by the irradiation portion 53 disposed on the most downstream side in the first drying portion 50.

Here, no contact member that comes into contact with the formation surface of the continuous paper P is disposed in the second feeding path. Such contact members include the wind rolls 26 where the continuous paper P is wound to bring the outer circumferential surfaces of the wind rolls 26 into contact with the formation surface of the continuous paper P.

A contact member that comes in contact with the continuous paper P through the non-formation surface is disposed in the second feeding path. Specifically, one of the aforementioned wind rolls 26 (hereinafter referred to as 26B) where the continuous paper P is wound to bring the outer circumferential surface of the wind roll 26B into contact with the non-formation surface of the continuous paper P is disposed in the second feeding path. That is, the wind roll 26B is an example of the contact member that comes in contact with the continuous paper P through the non-formation surface.

In this manner, only the contact member that comes in contact with the continuous paper P through the non-formation surface is disposed in the second feeding path. Incidentally, the configuration where "only the contact member that comes in contact with the continuous paper P through the non-formation surface is disposed" means the configuration where "only the contact member that comes in contact with the non-formation surface of the continuous paper P is disposed as a contact member that comes in contact with the continuous paper P". Accordingly, any member in no contact with the continuous paper P may be disposed to face the formation surface of the continuous paper P.

To say other words, the aforementioned wind roll 26B where the continuous paper P is wound is located on the downstream side in the feeding direction with respect to the first drying portion 50 and on the upstream side in the feeding direction with respect to the second drying portion 60. As a result, in the second feeding path, the feeding direction of the continuous paper P (the direction in which the continuous paper P is fed) is changed between the first drying portion 50 and the second drying portion 60. Specifically, the feeding direction of the continuous paper P is changed from a third direction going along the passageway 54 of the first drying portion 50 to a fourth direction going away from the irradiation portions 53 in a direction crossing the passageway 54.

To say other words, the fourth direction may be regarded as a direction on the non-formation surface side with respect to the formation surface of the continuous paper P fed in the third direction.

Specifically the third direction is a downward direction (direction going to the lower side). In addition, the third direction is the same direction as the aforementioned second direction in the first feeding path.

On the other hand, the fourth direction is a substantially horizontal direction. The fourth direction may be regarded as a lateral direction. Further, the fourth direction is also a direction going from the right to the left in FIG. 1.

Further, the third direction is also a direction in which the continuous paper P is discharged from the first drying portion 50. On the other hand, the fourth direction is a direction in which the continuous paper P enters the second drying portion 60. Accordingly, in the second feeding path, the direction in which the continuous paper P is discharged from the first drying portion 50 is different from the direction in which the continuous paper P enters the second drying portion 60.

The second feeding path is set at such a length that, within a set range of the feeding rate set by the feed mechanism 20, the moisture of the ink droplets irradiated with light from the irradiation portions 53 of the first drying portion 50 can be evaporated sufficiently before the image portion of the continuous paper P reaches the second drying portion 60.

The state where the moisture of the ink droplets has been evaporated sufficiently means a state where the difference between the moisture included in the image portion of the continuous paper P and the moisture included in the non-image portion of the continuous paper P has been reduced. Further, the state where the moisture of the ink droplets has been evaporated sufficiently means a state where the difference in moisture between the image portion and the non-image portion has been reduced to be too small to observe wrinkles generated due to a difference in shrinkage during drying in the second drying portion 60 caused by the difference in moisture between the image portion and the non-image portion.

When the length of the second feeding path is set in this manner, the length of the second feeding path is longer than the length of the first feeding path.

(Third Feeding Path of Continuous Paper P)

The third feeding path is a feeding path from the second drying portion 60 to the cooling portion 70. Specifically the third feeding path is a path between a position (start position) where the continuous paper P begins to leave the drying drum 62 of the second drying portion 60 and a position (end position) where the continuous paper P begins to come in contact with the cooling roll 72 of the cooling portion 70.

In the third feeding path, the continuous paper P is wound on one of the aforementioned wind rolls 26 (hereinafter referred to 26C) so that the formation surface of the continuous paper P can come in contact with the outer circumferential surface of the wind roll 26C. That is, the continuous paper P is wound on the wind roll 26C on the downstream side in the feeding direction with respect to the second drying portion 60 and on the upstream side in the feeding direction with respect to the cooling portion 70.

That is, in the exemplary embodiment, in the third feeding path, contact with the formation surface of the continuous paper P is carried out for the first time on the downstream side in the feeding direction with respect to the ejection unit 30.

(Operation in First Exemplary Embodiment)

According to the inkjet recording apparatus 10, ink droplets are ejected from the ejection unit 30 toward the formation surface of the continuous paper P fed from the unwind roll 22 toward the take-up roll 24. Thus, an image is formed in the formation surface.

The image portion of the continuous paper P is fed to the first drying portion 50 through the first feeding path. In the first drying portion 50, light energy is applied to the formation surface of the continuous paper P in a noncontact manner. Thus, the ink droplets in the image portion are dried.

Specifically, the irradiation portions 53 of the first drying portion 50 irradiate the formation surface with light of a wavelength in which the absorption rate in the ink droplets is higher than the absorption rate in the continuous paper P. Thus, the ink droplets in the image portion are dried.

Further, the image portion of the continuous paper P is fed to the second drying portion 60 through the second feeding path. In the second drying portion 60, the drying drum 62 in contact with only the non-formation surface of the continuous paper P heats the non-formation surface. Thus, the continuous paper P is dried. Then the continuous paper P is cooled by the cooling portion 70. After that, the continuous paper P is taken up by the take-up roll 24.

Here, in a configuration (first comparative example) where the second drying portion 60 dries the continuous paper P which has been held from the formation surface and the non-formation surface, pressure may be locally applied to the continuous paper P to thereby generate wrinkles in the continuous paper P.

On the other hand, according to the exemplary embodiment, the drying drum 62 comes in contact with only the non-formation surface of the continuous paper P. Thus, the generation of wrinkles in the recording medium is suppressed in comparison with the first comparative example.

In addition, according to the exemplary embodiment, the irradiation portions 53 of the first drying portion 50 irradiate the formation surface with light of a wavelength in which the absorption rate in the ink droplets is higher than the absorption rate in the continuous paper P. Moisture in the ink droplets and moisture in the continuous paper P are heated by the energy of the light. Thus, the moistures are evaporated so that the ink droplets and the continuous paper P are dried.

Here, in a configuration (second comparative example) in which the formation surface is irradiated with light of a wavelength in which the absorption rate in the continuous paper P is as high as the absorption rate in the ink droplets, wrinkles may be generated in the continuous paper P by the second drying portion 60 as follows. In the image portion of the continuous paper P, moisture of the ink droplets permeates the continuous paper P to cut hydrogen bonds among fibers (cellulose) of the continuous paper P. Thus, the continuous paper P swells. When the moisture contained in the continuous paper P (including the moisture of the ink droplets permeating the continuous paper P) is evaporated, the hydrogen bonds which have been cut among the fibers (cellulose) of the continuous paper P are recombined. Thus, the continuous paper P shrinks.

On the other hand, in the non-image portion of the continuous paper P, the continuous paper P shrinks when the moisture contained in the continuous paper P is evaporated.

In the image portion of the continuous paper P, the moisture amount is larger than that in the non-image portion of the continuous paper P in accordance with the moisture of the ink droplets permeating the image portion. However, in the second comparative example, the formation surface is irradiated with the light of the wavelength in which the absorption rate in the continuous paper P is as high as the absorption rate in the ink droplets. Therefore, the difference between the moisture amount in the image portion of the continuous paper P and the moisture amount in the non-image portion is hardly reduced.

As a result, when the moisture is evaporated by the second drying portion 60, a difference in shrinkage may occur between the image portion and the non-image portion of the continuous paper P to thereby generate wrinkles in the continuous paper P.

On the other hand, according to the exemplary embodiment, the irradiation portions 53 of the first drying portion 50 irradiate the formation surface with the light of the wavelength in which the absorption rate in the ink droplets is higher than the absorption rate in the continuous paper P. Accordingly, the difference between the moisture amount in the image portion of the continuous paper P and the moisture amount in the non-image portion may be reduced in comparison with the second comparative example. As a result, according to the configuration of the exemplary embodiment, the difference in shrinkage between the image portion and the non-image portion of the continuous paper P is suppressed to suppress the generation of wrinkles in the continuous paper P, in comparison with the second comparative example.

In addition, according to the exemplary embodiment, no contact member that comes in contact with the formation surface of the continuous paper P is disposed in the second feeding path. Accordingly, the ink droplets adhering to the continuous paper P are suppressed from being worn, in comparison with a configuration (third comparative example) in which a contact member that comes in contact with the formation surface of the continuous paper P is disposed in the second feeding path. As a result, image distortion in the continuous paper P is suppressed.

In addition, according to the exemplary embodiment, only the contact member that comes in contact with the continuous paper P through the non-formation surface is disposed in the second feeding path. Accordingly, it is possible to change the feeding direction of the continuous paper P in the second feeding path while suppressing the wearing of the ink droplets adhering to the continuous paper P, in comparison with a configuration (fourth comparative example) in which noncontact with the continuous paper P is kept in the second feeding path. Incidentally, the exemplary embodiment has a configuration in which the feeding direction of the continuous paper P is changed from the third feeding direction going along the passageway 54 of the first drying portion 50 to the fourth direction going away from the irradiation portions 53 in the direction crossing the passageway 54 in the second feeding path.

First Modified Example of First Drying Portion 50

Figure 2:
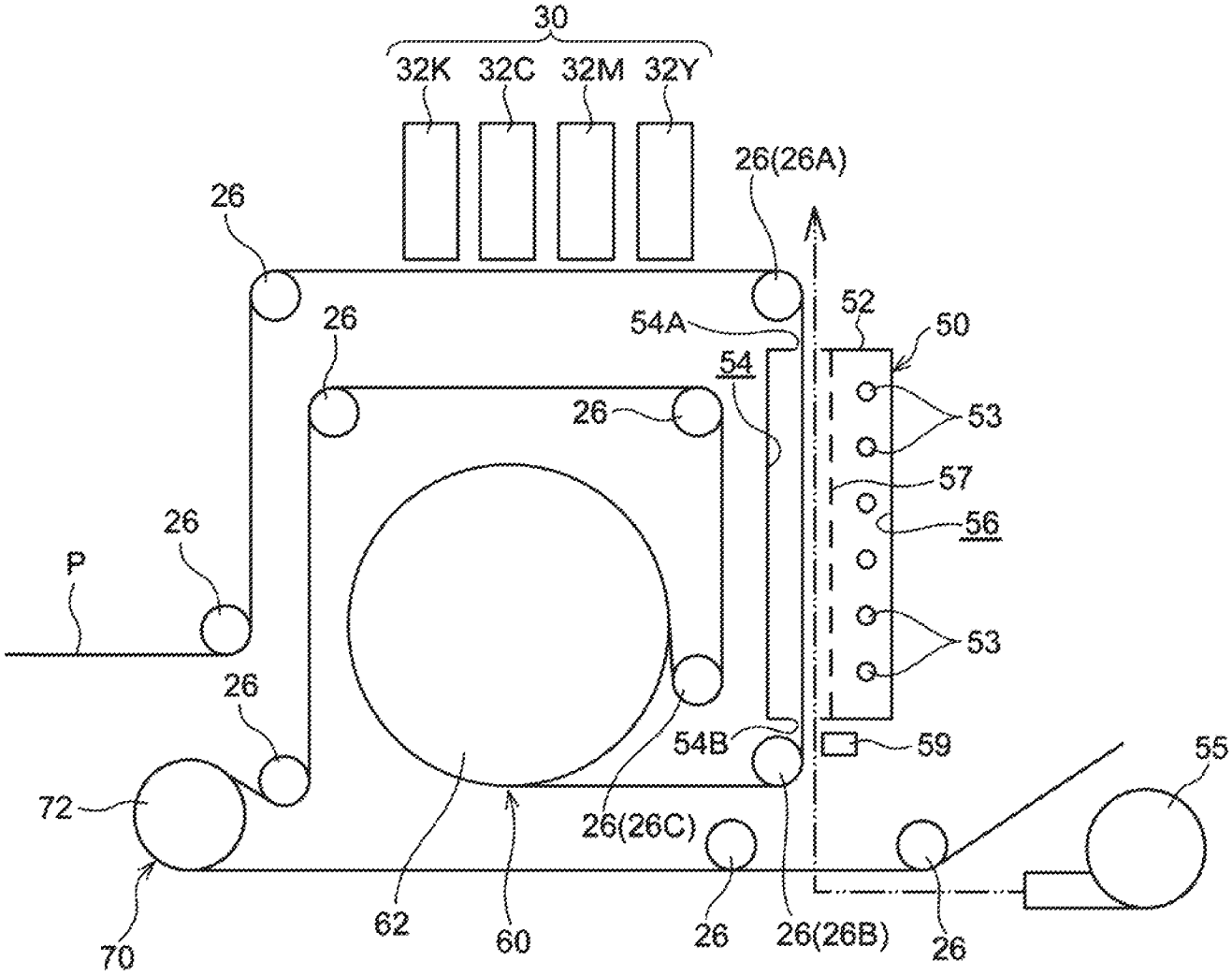
FIG. 2 is a schematic view illustrating a configuration of a first modified example of a first drying portion according to the first exemplary embodiment.

The first drying portion 50 may be configured to be provided with an air blower 55 that blows the air to a part of the continuous paper P fed through the passageway 54 (hereinafter referred to as fed part), as shown in FIG. 2.

The air blower 55 blows the air to the passageway 54 so that the air is applied onto the formation surface in the fed part of the continuous paper P. Specifically, the air blower 55 blows the air to the passageway 54 so that the air flows from the downstream side to the upstream side in the feeding direction and along the formation surface of the fed part of the continuous paper P. As a result, it is promoted to dry the ink droplets.

In another configuration, the air to be blown from the air blower 55 to the passageway 54 may be heated by a heating portion (not shown) so that the hot air is blown to the passageway 54.

Second Modified Example of First Drying Portion 50

Figure 3:
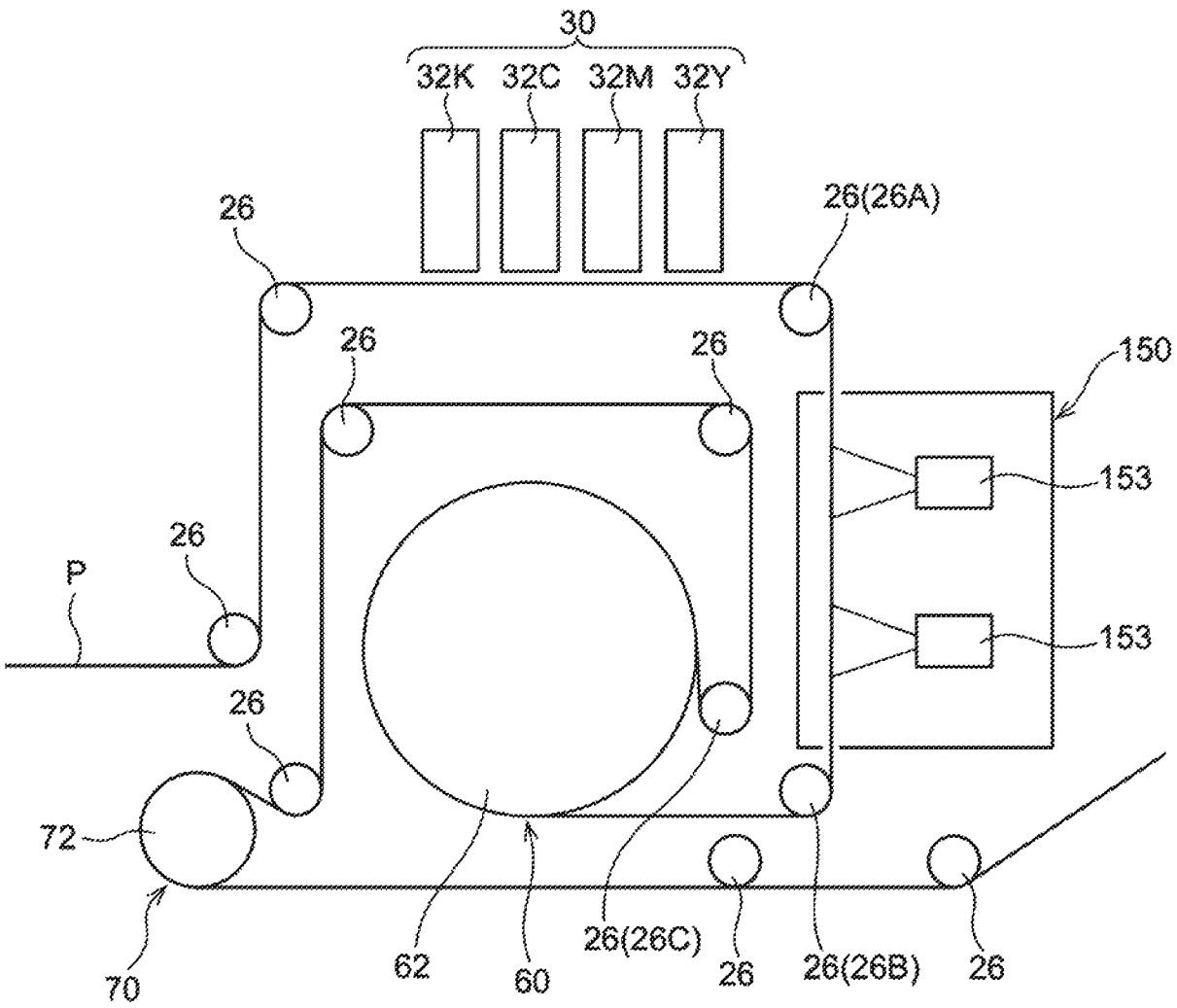
FIG. 3 is a schematic view illustrating a configuration of a second modified example of the first drying portion according to the first exemplary embodiment.

The first drying portion may be a first, drying portion 150 that is provided with irradiation portions 153 for irradiation with layer light, as shown in FIG. 3. The irradiation portions 153 irradiate the formation surface with light of a wavelength in which the absorption rate in the ink droplets is higher than the absorption rate in the continuous paper P. Specifically, the laser light irradiated from the irradiation portions 153 has a wavelength in a near-infrared range (not shorter than 0.7 μm and not longer than 1.4 μm). An absorbent for absorbing laser light may be added to the ink in order to increase the absorption rate of the laser light in the ink.

For example, the irradiation portions 153 have a configuration in which a plurality of surface emission lasers (VCSELs) are disposed in the feeding direction and the widthwise direction of the continuous paper P. This configuration may be arranged to control light emission of the surface emission lasers individually to thereby adjust the irradiation amount of the continuous paper P with the laser light.

Further, this configuration may be also arranged to apply the air onto a part fed through the first drying portion 150, in the same manner as in the first modified example shown in FIG. 2.

Modified Example of Second Drying Portion 60

Figure 4:
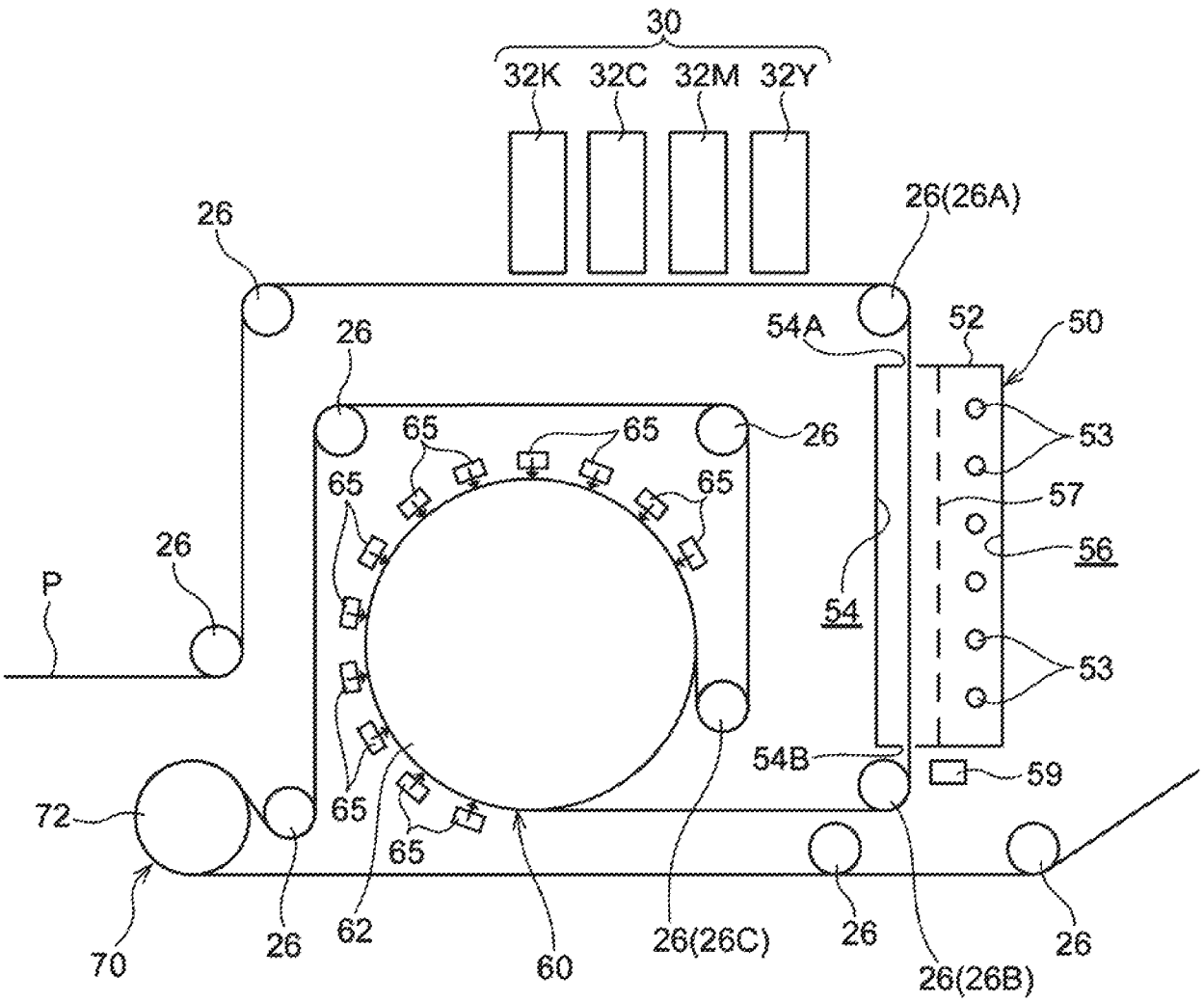
FIG. 4 is a schematic view illustrating a configuration of a modified example of a second drying portion according to the first exemplary embodiment.

The second drying portion 60 may be configured to be provided with air blowers 65 that blow the air to a part of the continuous paper P wound on the drying drum 62 (hereinafter referred to as wound part), as shown in FIG. 4.

The air blowers 65 are disposed to face the wound part of the continuous paper P and extend in the circumferential direction of the drying drum 62. The air blowers 65 apply the air onto the formation surface in the wound part of the continuous paper P. As a result, it is promoted to dry the continuous paper P.

In another configuration, the air to be applied from the air blowers 65 onto the continuous paper P may be heated by a heating portion (not shown) so that the hot air is applied onto the continuous paper P. In further another configuration, the air may be blown in the circumferential direction of the drying drum 62 and along the wound part of the continuous paper P.

Modified Example of Second Feeding Path

Figure 5:
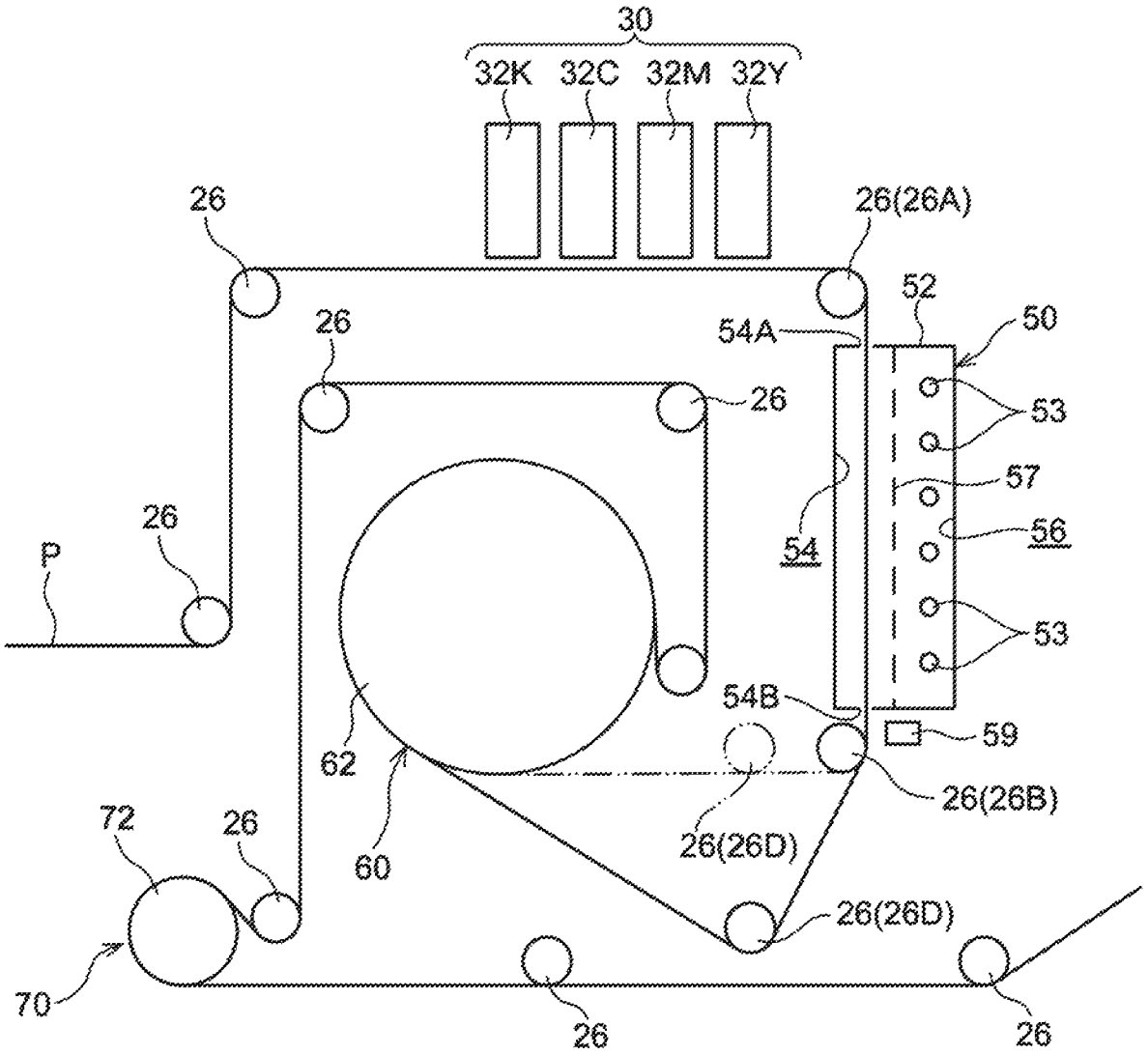
FIG. 5 is a schematic view illustrating a configuration of a modified example of a second feeding path according to the first exemplary embodiment.

The second feeding path may be configured to have a variable length, as shown in FIG. 5. Specifically, in the second feeding path, a wind roll 26 (hereinafter referred to as 26D) that allows the non-formation surface of the continuous paper P to come in contact with the outer circumferential surface of the wind roll 26D is disposed on the downstream side in the feeding direction with respect to the wind roll 26B.

The wind roll 26D is movable between a first position (the position designated by the alternate long and two short dashed line) and a second position (the position designated by the solid line) in the up/down direction in FIG. 5. When the wind roll 26D is located in the first position, the continuous paper P is fed in a straight line from the wind roll 26B toward the drying drum 62. When the wind roll 26D is located in the second position, the continuous paper P is fed from the wind roll 26B to the drying drum 62 while bypassing the wind roll 26D. In this manner, it is possible to adjust the time to evaporate the moisture of the ink droplets irradiated with the light by the first drying portion 50.

For example, the length of the second feeding path may be changed in accordance with the feeding rate of the continuous paper P. For example, when the feeding rate of the continuous paper P is increased, the length of the second feeding path is increased. Thus, even when the feeding rate of the continuous paper P is increased, it is possible to secure the time to evaporate the moisture of the ink droplets.

Other Modified Examples of First Embodiment

Although the wind roll 26B is used as an example of a contact member that comes in contact with the continuous paper P through the non-formation surface in the second feeding path according to the exemplary embodiment, the contact member is not limited thereto. The contact member may be a guide member (guide) that comes in contact with the non-formation surface of the continuous paper P to guide the continuous paper P. For example, the guide member is configured not to rotate, so that the continuous paper P moves sliding on the guide member. Thus, the contact member may be a member that rotates or a member that does not rotate.

Second Embodiment

Figure 6:
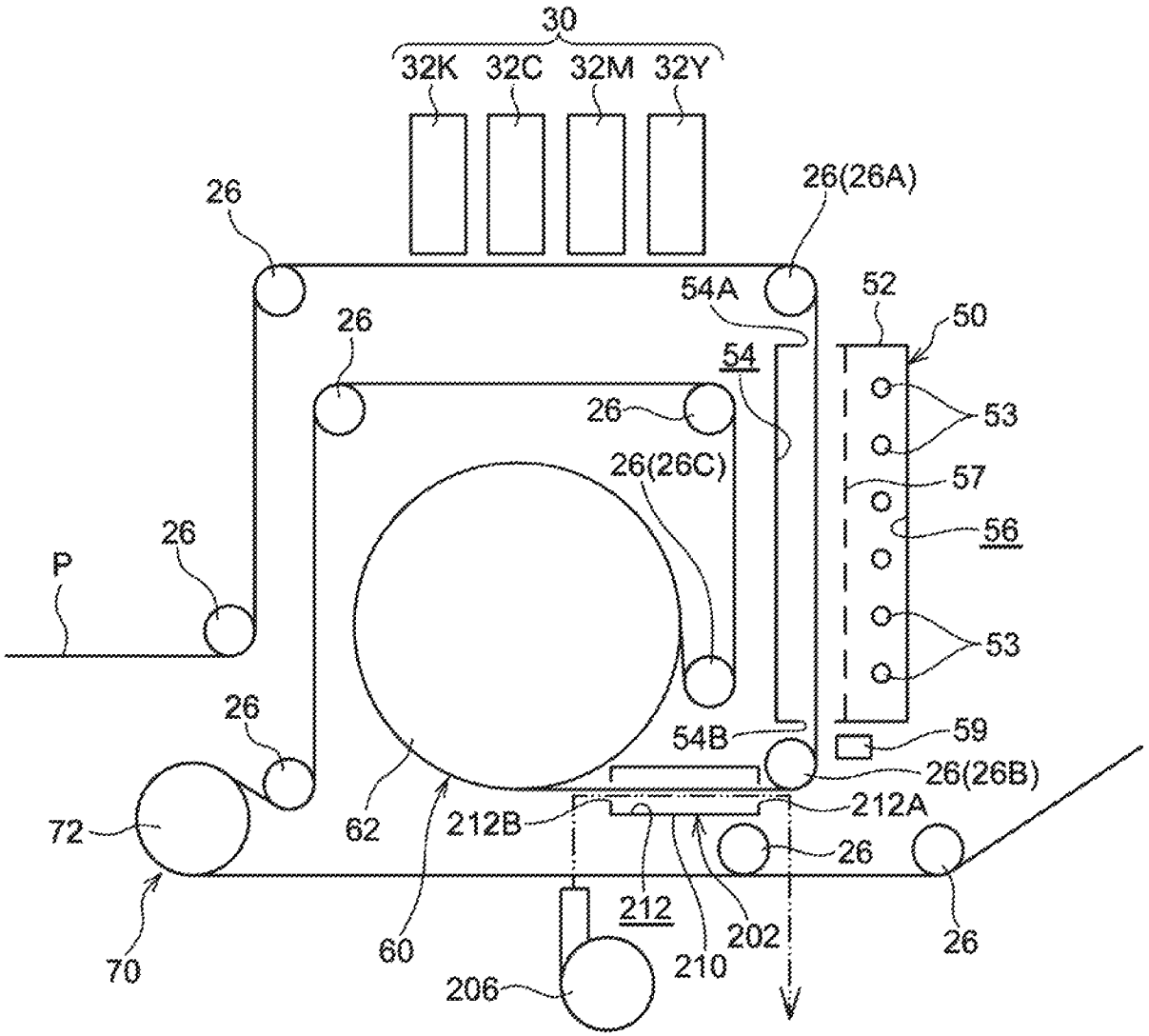
FIG. 6 is a schematic view illustrating a configuration of an inkjet recording apparatus according to a second exemplary embodiment.

Next, an inkjet recording apparatus 200 according to a second exemplary embodiment will be described. FIG. 6 is a view illustrating the inkjet recording apparatus according to the second exemplary embodiment. Incidentally, parts configured in the same manner as those in the first exemplary embodiment are referenced correspondingly, and description thereof will be omitted accordingly.

The inkjet recording apparatus 200 has an evaporation promoting chamber 202 and an air blower 206. In this point, the inkjet recording apparatus 200 is different from the inkjet recording apparatus 10. Incidentally, except that the inkjet recording apparatus 200 has the evaporation promoting chamber 202 and the air blower 206, the inkjet recording apparatus 200 is configured in the same manner as the inkjet recording apparatus 10.

The evaporation promoting chamber 202 is an example of a promotion chamber that promotes evaporation of moisture of liquid droplets. Specifically, the evaporation promoting chamber 202 is a promotion chamber that promotes evaporation of moisture of the ink droplets irradiated with the light by the first drying portion 50. More specifically the evaporation promoting chamber 202 reduces relative humidity around the continuous paper P to thereby promote evaporation of moisture of the ink droplets. Further more specifically the evaporation promoting chamber 202 is configured as follows.

The evaporation promoting chamber 202 is disposed in the second feeding path. Specifically the evaporation promoting chamber 202 is disposed between the wind roll 26B and the drying drum 62 in the second feeding path.

The evaporation promoting chamber 202 has a housing 210. A passageway 212 through which the continuous paper P is fed is formed inside the housing 210. The passageway 212 is formed along the left/right direction in FIG. 6. In addition, the passageway 212 has an inlet 212A and an outlet 212B. The continuous paper P is introduced into the passageway 212 through the inlet 212A, and discharged through the outlet 212B.

The air blower 206 is an air blower that blows the air to a part (hereinafter referred to as fed part) of the continuous paper P fed through the passageway 212. Specifically the air blower 206 blows the air to the passageway 212 so as to apply the air onto the formation surface in the fed part of the continuous paper P. Specifically the air blower 206 blows the air to the passageway 212 so that the air flows from the downstream side to the upstream side in the feeding direction and along the formation surface in the fed part of the continuous paper P.

In addition, it is desired that the air to be blown by the air blower 206 is dried. That is, it is desired that the air to be blown by the air blower 206 is low in humidity. For example, the humidity of the blown air is set at 20% or less.

The velocity of the air blown by the air blower 206 can be changed in accordance with the feeding rate of the continuous paper P. Specifically the air blower 206 is arranged to increase the velocity of the air when the feeding rate of the continuous paper P is increased.

More specifically, the air blower 206 may be, for example, arranged so that velocities of the air are associated with feeding rates of the continuous paper P in advance, and the air blower 206 is driven to blow the air at a velocity associated with a current feeding rate of the continuous paper P. In this configuration, when the feeding rate of the continuous paper P is changed, the velocity of the air is changed to a velocity associated with the changed feeding rate.

In the exemplary embodiment, the feeding rate of the continuous paper P can be changed at intervals of 10 m/min within the range not higher than 100 m/min and not lower than 20 m/min by way of example, as described above. For example, feeding rates of 20, 30 and 40 m/min are associated with a first air velocity, feeding rates of 50, 60 and 70 m/min are associated with a second air velocity which is higher than the first air velocity, and feeding rates of 80, 90 and 100 m/min are associated with a third air velocity which is higher than the second air velocity, in advance. For example, in the feeding rate of 20, 30 or 40 m/min, the air blower 206 is driven to blow the air at the first air velocity. When the feeding rate is changed to the feeding rate of 50, 60 or 70 m/min, driving the air blower 206 is controlled to blow the air at the second air velocity which is higher than the first air velocity.

(Operation in Second Exemplary Embodiment)

According to the inkjet recording apparatus 200, evaporation of moisture of the ink droplets irradiated with the light by the first drying portion 50 is promoted. Accordingly, the difference between the moisture amount in the image portion of the continuous paper P and the moisture amount in the non-image portion is reduced in comparison with a configuration (fifth comparative example) in which the continuous paper P is sent from the first drying portion 50 to the second drying portion 60 directly without going through the evaporation promoting chamber 202. As a result, according to the configuration of the exemplary embodiment, a difference in shrinkage between the image portion and the non-image portion of the continuous paper P is suppressed to suppress the generation of wrinkles in the continuous paper P, in comparison with the fifth comparative example.

In addition, since the evaporation of moisture of the ink droplets irradiated with the light by the first drying portion 50 is promoted by the evaporation promoting chamber 202, the time required to evaporate a required amount of the moisture is shortened in comparison with the fifth comparative example. As a result, the second feeding path is shortened to miniaturize the apparatus.

In addition, according to the exemplary embodiment, the air blower 206 blows the air to the passageway 212 along the formation surface in the fed part of the continuous paper P. Accordingly, the evaporation of moisture of the ink droplets is promoted in comparison with a configuration (sixth comparative example) in which the air is blown along the non-formation surface of the continuous paper P. As a result, generation of wrinkles in the continuous paper P is suppressed.

Further, according to the exemplary embodiment, the velocity of the air blown by the air blower 206 can be changed in accordance with the feeding rate of the continuous paper P. Specifically the velocity of the air blown by the air blower 206 increases when the feeding rate of the continuous paper P is increased.

Here, in a configuration (seventh comparative example) in which the velocity of the air blown by the blower 206 is fixed, the time for the continuous paper P to pass through the second feeding path changes when the feeding rate of the continuous paper P is changed. That is, the time to evaporate moisture of the ink drops irradiated with the light by the first drying portion 50 changes to change the degree of the evaporation of the moisture. Specifically, when the feeding rate of the continuous paper P is increased, the time to evaporate the moisture of the ink drops is shortened so that the continuous paper P in which the moisture in the ink drops has not been evaporated sufficiently may be sent to the second drying portion 60. On the other hand, the velocity of the air blown by the air blower 206 can be changed in accordance with the feeding rate of the continuous paper P. Therefore, the velocity of the air can be, for example, increased when the feeding rate of the continuous paper P is increased. Thus, the evaporation of the moisture can be promoted even when the feeding rate is changed, in comparison with the seventh comparative example.

First Modified Example of Second Exemplary Embodiment

Figure 7:
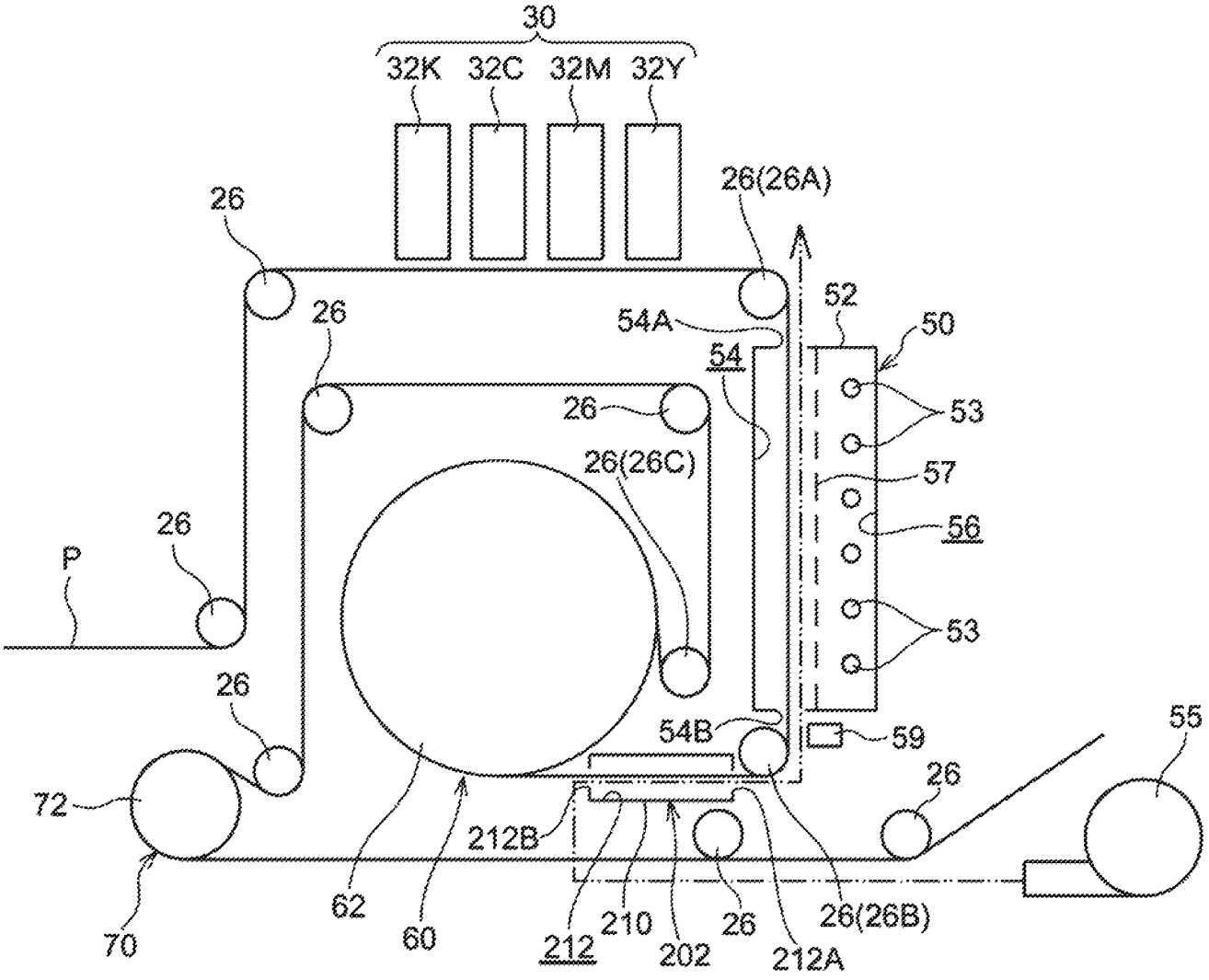
FIG. 7 is a schematic view illustrating a configuration of a first modified example of the second exemplary embodiment.

The aforementioned first modified example of the first drying portion 50 shown in FIG. 2 may be also applied to the second embodiment. In this case, in another configuration, the air may be blown by the air blower 55 in place of the air blower 206 as shown in FIG. 7. In the configuration arranged thus, the air is blown to the first drying portion 50 from the evaporation promoting chamber 202 disposed on the downstream side with respect to the first drying portion 50.

Specifically, the air blower 55 blows the air to the passageway 212 of the evaporation promoting chamber 202 so that the air flows from the downstream side to the upstream side in the feeding direction and along the formation surface in the fed part of the continuous paper P. In this configuration, the air blower 206 is not required. Accordingly, the number of components is reduced in comparison with a configuration (eighth comparative example) in which the air is blown to the passageway 212 of the evaporation promoting chamber 202 by another blower than the air blower 55.

Second Modified Example of Second Embodiment

Figure 8:
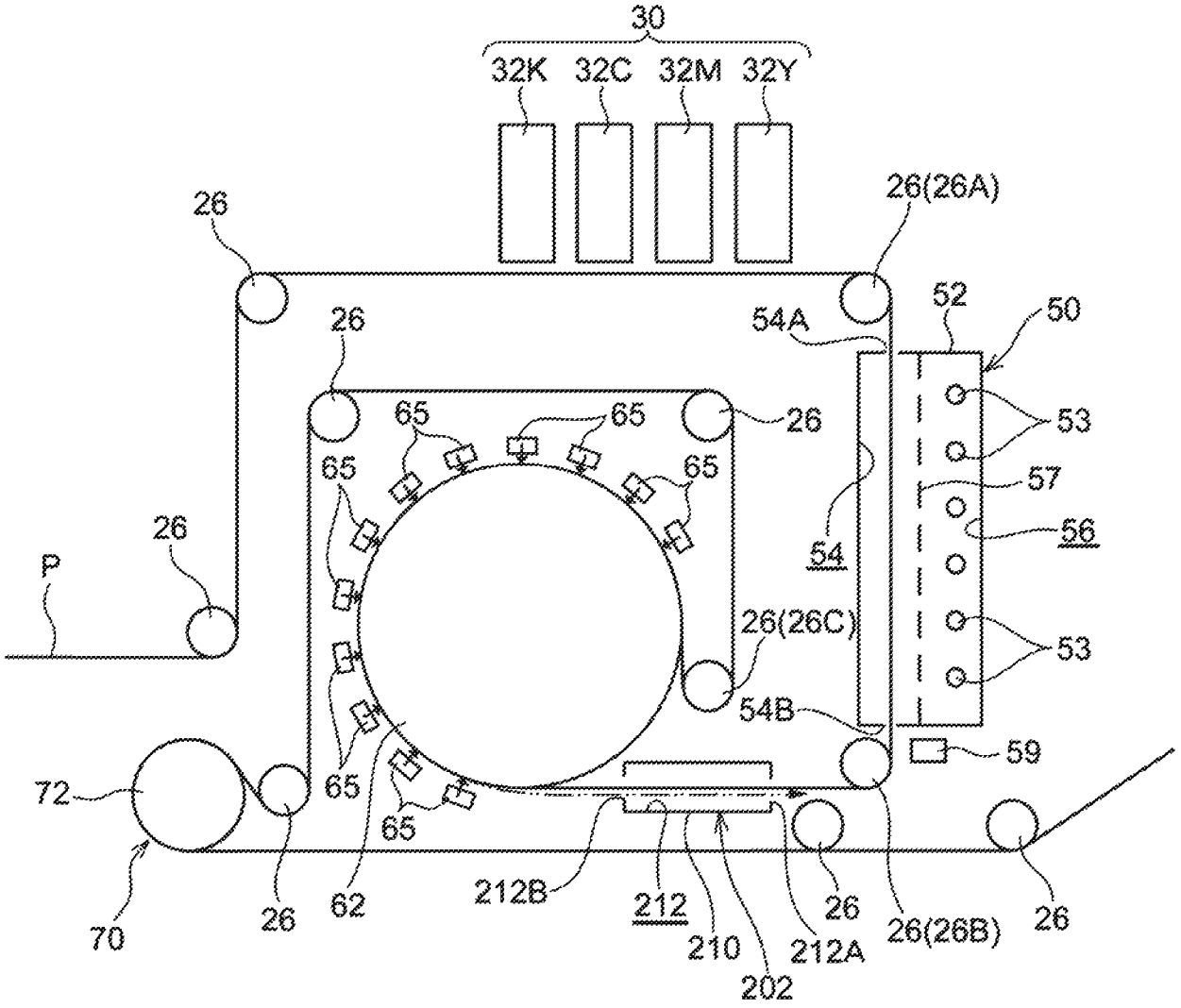
FIG. 8 is a schematic view illustrating a configuration of a second modified example of the second exemplary embodiment.

The aforementioned modified example of the second drying portion 60 shown in FIG. 4 may be also applied to the second embodiment. In this case, in another configuration, the air may be blown by the air blower 65 in place of the air blower 206 as shown in FIG. 8.

Specifically, the air blower 65 blows the air to the passageway 212 of the evaporation promoting chamber 202 so that the air flows from the downstream side to the upstream side in the feeding direction and along the formation surface of the fed part of the continuous paper P. In this configuration, the air blower 206 is not required. Accordingly, the number of components is reduced in comparison with a configuration (ninth comparative example) in which the air is blown to the passageway 212 of the evaporation promoting chamber 202 by another blower than the air blower 65.

Incidentally, in another configuration, the air may be blown by use of both the air blower 55 and the air blower 65 in place of the air blower 206.

Other Modified Examples of Second Embodiment

Although the air blower 206 blows the air to the passageway 212 so that the air flows from the downstream side to the upstream side in the feeding direction and along the formation surface in the fed part of the continuous paper P in the second embodiment, the air blower 206 is not limited thereto. The air blower 206 may blow the air to the passageway 212 so that the air flows from the upstream side to the downstream side in the feeding direction. In addition, the air blower 206 may apply the air to the formation surface in the fed part of the continuous paper P perpendicularly to the formation surface.

Although the velocity of the air blown by the air blower 206 can be changed in accordance with the feeding rate of the continuous paper P in the second embodiment, the air blower 206 is not limited thereto. The air blower 206 may be arranged so that the velocity of the air blown by the air blower 206 is fixed.

The present invention is not limited to the aforementioned embodiments, but various changes, modifications or improvements can be made without departing from the gist of the invention. For example, a plurality of the aforementioned modified examples may be combined and arranged suitably.

(Evaluation)

A rectangular solid image having two colors superimposed on each other and having a desired size is formed within an image region in continuous paper P on the following conditions in each of the case where the evaporation promoting chamber 202 is provided and the case where the evaporation promoting chamber 202 is not provided. Generation of wrinkles in the continuous paper P formed thus is evaluated. The wrinkles in the continuous paper P are checked visually.

[Conditions]

feeding rate of continuous paper P: 50 m/min continuous paper P: OK top coat+ (manufactured by OJI PAPER CO., LTD., basis weight of 127.9 g/m$^2$)

temperature of paper having passed through first drying portion 50: 70° C.

drum temperature of drying drum 62: 110° C.

temperature of hot air blown by air blower 65: 110° C.

temperature of air in evaporation promoting chamber 202: 25° C.

[Evaluation Results]

As shown in FIG. 9, it is found that wrinkles are generated in the continuous paper P when the evaporation promoting chamber 202 is provided in the second feeding path which is 1,500 mm or 2,000 mm, while no wrinkles are generated in the continuous paper P when the evaporation promoting chamber 202 is provided in the same second feeding path. Thus, it is found that generation of wrinkles can be suppressed when the evaporation promoting chamber 202 is provided.

In addition, it is found that generation of wrinkles in the continuous paper P could not be suppressed unless the second feeding path had a length of 2,500 mm or more in the case where the evaporation promoting chamber 202 is not provided, while generation of wrinkles in the continuous paper P could be suppressed if the second feeding path had a length of 1,500 mm or more in the case where the evaporation promoting chamber 202 is provided. Thus, it is found that the distance of the second feeding path (the feeding time in the second feeding path) can be shortened when the evaporation promoting chamber 202 is provided.

Incidentally, the moisture content shown in FIG. 9 is a value obtained as follows. An infrared multicomponent analyzer is placed just before the drying drum 62. The infrared multicomponent analyzer irradiates an image portion with infrared rays whose wavelength is in an absorption range of water, so that the infrared multicomponent analyzer can measure a value of the absorbance in the image portion. On the other hand, a plurality of paper samples containing predetermined moisture contents are prepared in advance, and moisture contents of the paper samples are obtained by an electric resistance type moisture content meter. Values of absorbance of the samples obtained by the infrared multicomponent analyzer and the moisture contents of the samples obtained by the electric resistance type moisture content meter are associated with each other to create a calibration curve between the both. Using the calibration curve obtained thus, a value of absorbance obtained from the image portion is converted into a moisture content.

Third Embodiment

Figure 10:
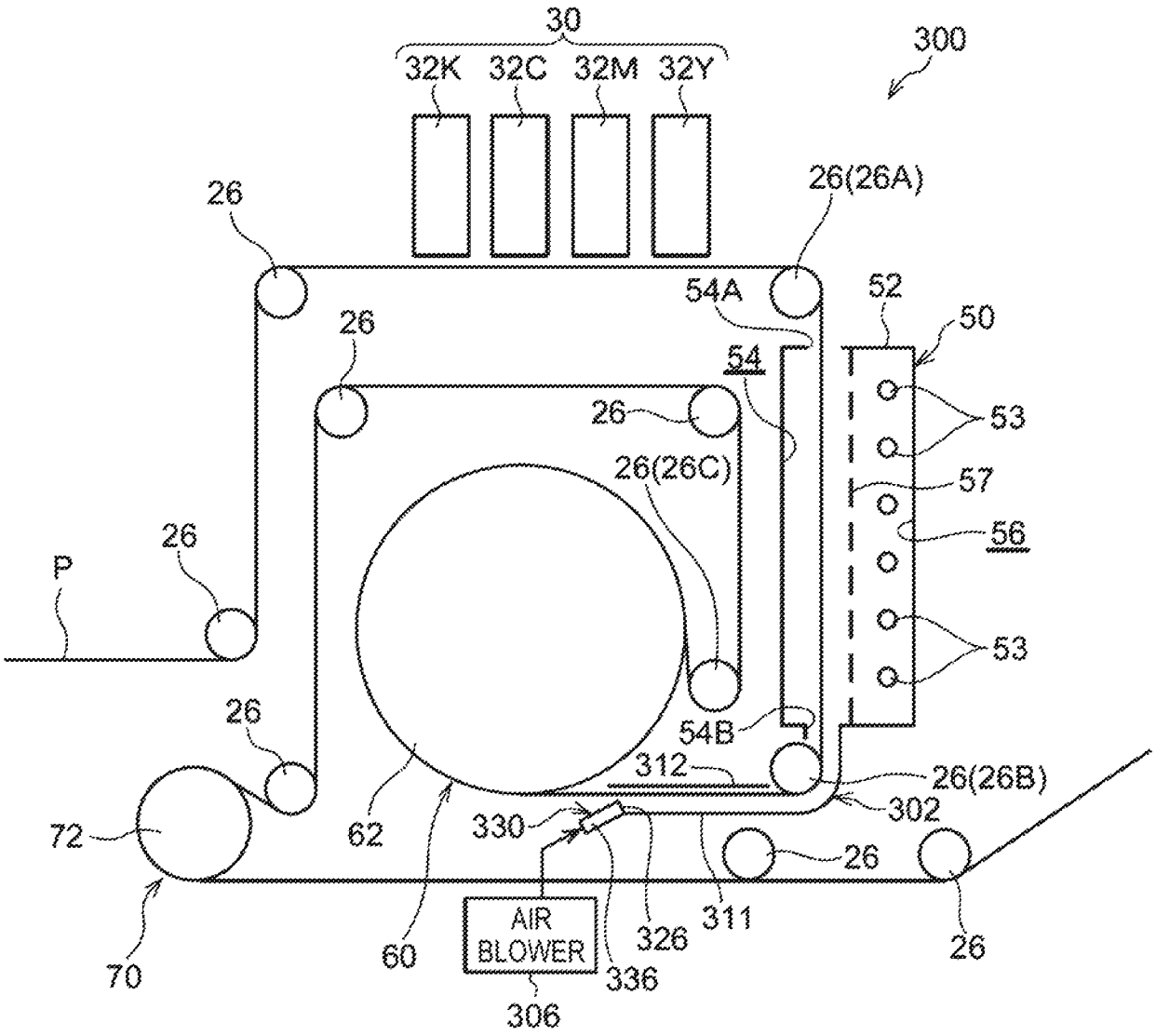
FIG. 10 is a schematic view illustrating a configuration of an inkjet recording apparatus according to a third exemplary embodiment.

Next, an inkjet recording apparatus 300 according to a third exemplary embodiment will be described. FIG. 10 is a view illustrating the inkjet recording apparatus according to the third exemplary embodiment. Incidentally, parts configured in the same manner as those in the first exemplary embodiment are referenced correspondingly, and description thereof will be omitted accordingly.

The inkjet recording apparatus 300 has an evaporation promoting chamber 302 and an air blower 306 as shown in FIG. 10. In this point, the inkjet recording apparatus 300 is different from the inkjet recording apparatus 10. Incidentally, except that the inkjet recording apparatus 300 has the evaporation promoting chamber 302 and the air blower 306, the inkjet recording apparatus 300 is configured in the same manner as the inkjet recording apparatus 10.

The evaporation promoting chamber 302 is an example of a promotion chamber that promotes evaporation of moisture of liquid droplets. Specifically, the evaporation promoting chamber 302 is a promotion chamber that promotes evaporation of moisture of the ink droplets irradiated with the light by the first drying portion 50. More specifically the evaporation promoting chamber 302 reduces relative humidity around the continuous paper P (at least a space on the formation surface side of the continuous paper P) to thereby promote evaporation of moisture of the ink droplets. Further more specifically the evaporation promoting chamber 302 is configured as follows.

The evaporation promoting chamber 302 is disposed in the second feeding path. That is, the evaporation promoting chamber 302 is disposed in the feeding path between the first drying portion 50 and the second drying portion 60.

Figure 11:
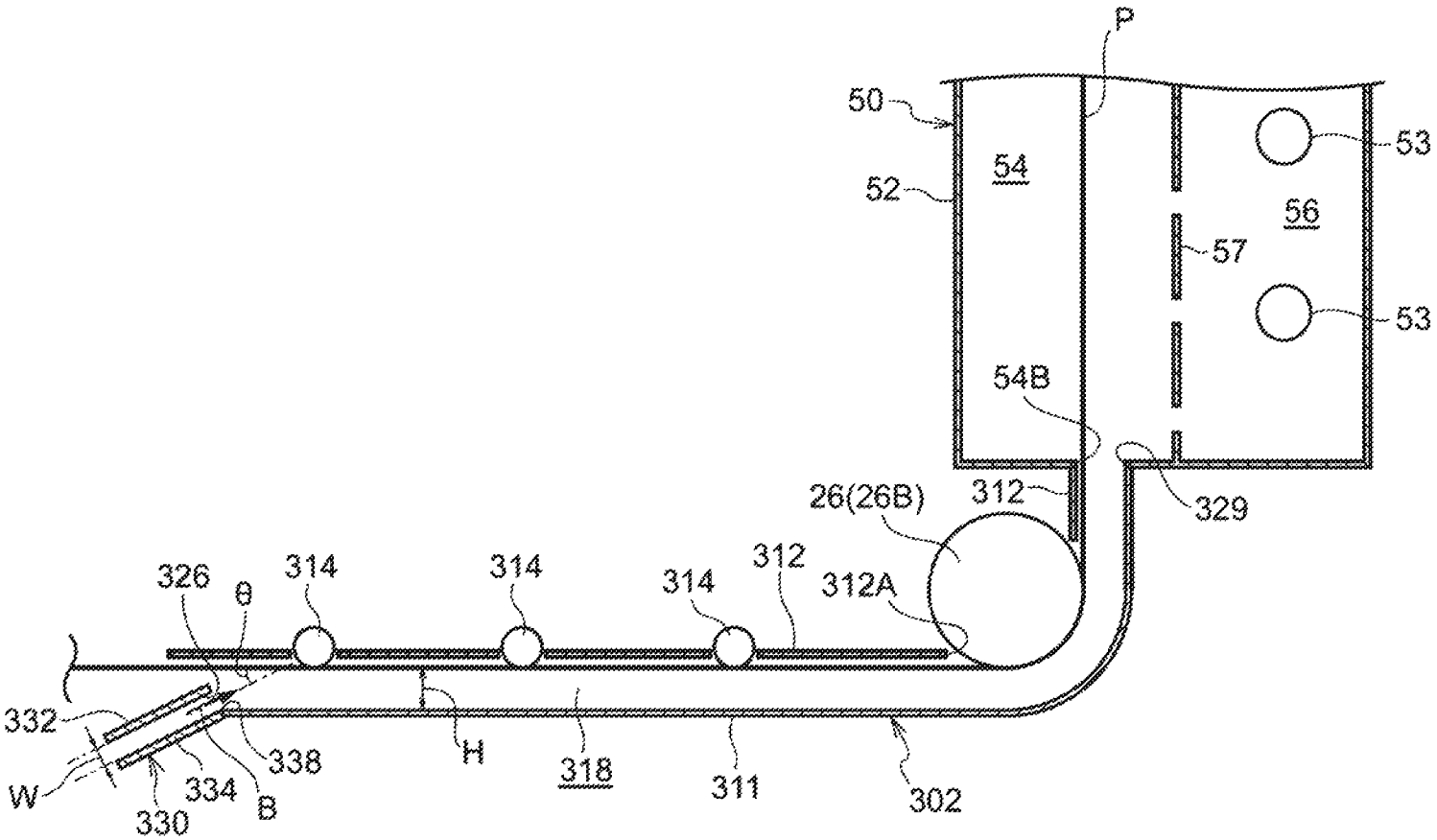
FIG. 11 is an enlarged schematic view illustrating a part of the configuration of the inkjet recording apparatus according to the third exemplary embodiment.

The evaporation promoting chamber 302 has a first opposed wall 311 (an example of an opposed wall) that is opposed to the formation surface of the continuous paper P, and a second opposed wall 312 (an example of a wall portion) that is opposed to the non-formation surface of the continuous paper P, as shown in FIG. 11. Further, the evaporation promoting chamber 302 has an air blowing duct 330 (air blowing pipe) and an air blowing port 326. The air from the air blower 306 (see FIG. 10) is sent to a space between the first opposed wall 311 and the second opposed wall 312 through the air blowing duct 330. The air blowing port 326 is formed in the air blowing duct 330.

The air blower 306 is a device that generates a blast of air and sends the blast of air to the air blowing duct 330. Examples of the air blower 306 may include a multi-blade blower (such as a sirocco fan), a centrifugal blower that blows the air centrifugally, an axial blower that blows the air axially, etc.

The first opposed wall 311 of the evaporation promoting chamber 302 is disposed along the formation surface of the continuous paper P. The first opposed wall 311 is disposed between the outlet 54B of the first drying portion 50 and the air blowing duct 330. In addition, the first opposed wall 311 is bent along the outer circumference of the wind roll 26B at a part opposed to the continuous paper P wound on the wind roll 26B. Further, the width of the first opposed wall 311 in the widthwise direction of the continuous paper P is made larger than that of the continuous paper P. Specifically, the widthwise opposite end portions of the first opposed wall 311 project outward in the widthwise direction with respect to the widthwise opposite end portions of the continuous paper P (specifically the continuous paper P having maximum width capable of being fed) respectively.

The second opposed wall 312 is disposed along the non-formation surface of the continuous paper P. The second opposed wall 312 is disposed between the outlet 54B of the first drying portion 50 and the air blowing duct 330. In addition, in the second opposed wall 312, an opening 312A is formed at a part where the wind roll 26B is disposed. The width of the second opposed wall 312 in the widthwise direction of the continuous paper P is made larger than that of the continuous paper P. Specifically, the widthwise opposite end portions of the second opposed wall 312 project outward in the widthwise direction of the continuous paper P with respect to the widthwise opposite end portions of the continuous paper P (specifically the continuous paper P having maximum width capable of being fed) respectively.

The second opposed wall 312 also functions as a guide member (guide) that comes in contact with the non-formation surface of the continuous paper P so as to guide the continuous paper P. That is, the second opposed wall 312 may be also regarded as an example of a contact member that comes in contact with the continuous paper P through the non-formation surface. Further, the second opposed wall 312 is provided with a plurality (specifically, three) of contact rollers 314 that come in contact with the non-formation surface of the continuous paper P. That is, each contact roller 314 is an example of the contact member that comes in contact with the continuous paper P through the non-formation surface. The contact rollers 314 are driven and rotated by the continuous paper P.

The air blowing duct 330 has an upper wall portion 332 (see FIG. 11), a lower wall portion 334 (see FIG. 11), and a pair of side wall portions 336 (see FIG. 10). In FIG. 11, a part of the air blowing duct 330 is illustrated.

The upper wall portion 332 is a wall portion that constitutes an upper portion of the air blowing duct 330. The lower wall portion 334 is a wall portion that constitutes a lower portion of the air blowing duct 330. The upper wall portion 332 extends from the first opposed wall 311 side toward the upstream side in the feeding direction of the continuous paper P and obliquely to the formation surface of the continuous paper P in side sectional view. The lower wall portion 334 is disposed under the upper wall portion 332 and along the upper wall portion 332 in side sectional view. That is, the lower wall portion 334 also extends from the first opposed wall 311 side toward the upstream side in the feeding direction of the continuous paper P and obliquely to the formation surface of the continuous paper P in the same manner as the upper wall portion 332.

In addition, the lower wall portion 334 is disposed in a position more distant from the continuous paper P than the upper wall portion 332. In addition, the lower wall portion 334 is disposed on the upstream side in the feeding direction of the continuous paper P with respect to the upper wall portion 332.

The upper wall portion 332 and the lower wall portion 334 are set so that the width in the widthwise direction of the continuous paper P is larger than that of the continuous paper P. Specifically, each of the widthwise opposite end portions of the upper wall portion 332 and the lower wall portion 334 projects outward in the widthwise direction of the continuous paper P with respect to each of the widthwise opposite end portions of the continuous paper P (specifically the continuous paper P having maximum width capable of being fed). Incidentally, the pair of side wall portions 336 (see FIG. 10) connect the widthwise opposite end portions of the upper wall portion 332 and the lower wall portion 334 with each other respectively.

The air blowing port 326 is arranged as an air blowing port that blows the air from the first opposed wall 311 side toward the upstream side in the feeding direction of the continuous paper P and obliquely to the formation surface of the continuous paper P. Accordingly, the direction of the air blown through the air blowing port 326 is adjusted to a direction (the obliquely right upper (arrow B) in FIG. 11) going obliquely to the formation surface of the continuous paper P and toward the upstream side in the feeding direction of the continuous paper P. In addition, an angle θ (see FIG. 11) of the air blowing direction with respect to the continuous paper P is, for example, set within a range not smaller than 20° and not larger than 60°.

The air blowing port 326 is formed into a rectangular shape having length in the widthwise direction of the continuous paper P. The air blowing portion 326 is formed so that the length in the widthwise direction of the continuous paper P is longer than the width of the continuous paper P. Specifically, each of the longitudinally opposite end portions of the air blowing port 326 projects outward in the widthwise direction of the continuous paper P with respect to each of the widthwise opposite end portions of the continuous paper P (specifically the continuous paper P having maximum width capable of being fed). Incidentally, in the air blowing port 326, the length in the widthwise direction of the continuous paper P may be, for example, as large as the width of the continuous paper P, or may be shorter than the width of the continuous paper P. A width W (see FIG. 11) between the lower wall portion 334 and the upper wall portion 332 in the air blowing port 326 is, for example, made not smaller than 5 mm and not larger than 20 mm. In addition, a distance between the upper edge (the closest edge to the continuous paper P) in the air blowing port 326 and the continuous paper P is set at a distance large enough for the continuous paper P not to touch the upper edge even when fluttering or the like occurs. The distance is, for example, set at 10 mm or more.

The air blown out from the air blowing port 326 propagates in a space between the first opposed wall 311 and the formation surface of the continuous paper P and flows along the formation surface and toward the upstream side in the feeding direction. That is, the space between the first opposed wall 311 and the formation surface of the continuous paper P functions as a flow passageway 318 where the air flows. Height H (see FIG. 11) of the flow passageway 318 is, for example, set to be not smaller than 10 mm and not larger than 100 mm.

An outer edge 338 of the air blowing port 326 on the upstream side in the feeding direction is disposed on the first opposed wall 311 side (lower side) with respect to the flow passageway 318. Specifically, the outer edge 338 is connected to the first opposed wall 311. That is, the outer edge 338 does not project into the flow passageway 318. Incidentally, the outer edge 338 also serves as an outer edge of the air blowing port 326 on the first opposed wall 311 side (on the distant side from the continuous paper P). That is, the outer edge 338 also serves as a lower outer edge of the air blowing port 326

It is desired that the air blown out through the air blowing port 326 has been dried. That is, it is desired that the air blown out through the air blowing port 326 is low in humidity. The humidity of the blown air is, for example, set at 20% or less.

In addition, the velocity of the air blown out through the air blowing port 326 may be changed in accordance with the feeding rate of the continuous paper P. Specifically, the air blower 306 has a configuration in which the velocity of the air increases when the feeding rate of the continuous paper P is increased.

(Operation in Third Exemplary Embodiment)

According to the inkjet recording apparatus 300, evaporation of moisture of the ink droplets irradiated with the light by the first drying portion 50 is promoted in the evaporation promoting chamber 302. Accordingly, the difference between the moisture amount in the image portion of the continuous paper P and the moisture amount in the non-image portion is reduced in comparison with a configuration (tenth comparative example) in which the continuous paper P is sent from the first drying portion 50 to the second drying portion 60 directly without going through the evaporation promoting chamber 302. As a result, according to the configuration of the exemplary embodiment, a difference in shrinkage between the image portion and the non-image portion of the continuous paper P is suppressed to suppress the generation of wrinkles in the continuous paper P, in comparison with the tenth comparative example.

In addition, since the evaporation of moisture of the ink droplets irradiated with the light by the first drying portion 50 is promoted by the evaporation promoting chamber 302, the time required to evaporate a required amount of the moisture is shortened in comparison with the tenth comparative example. As a result, the second feeding path is shortened to miniaturize the apparatus.

In addition, according to the exemplary embodiment, the air blowing port 326 of the air blowing duct 330 blows the air from the first opposed wall 311 side toward the upstream side in the feeding direction of the continuous paper P and obliquely to the formation surface of the continuous paper P. Accordingly, the relative velocity of the blown air to the formation surface of the continuous paper P increases in comparison with a configuration (eleventh comparative example) in which the air is blown toward the downstream side in the feeding direction of the continuous paper P. Thus, the evaporation of the moisture of the ink droplets is promoted in comparison with the eleventh comparative example. As a result, the generation of wrinkles in the continuous paper P is suppressed.

Figure 12:
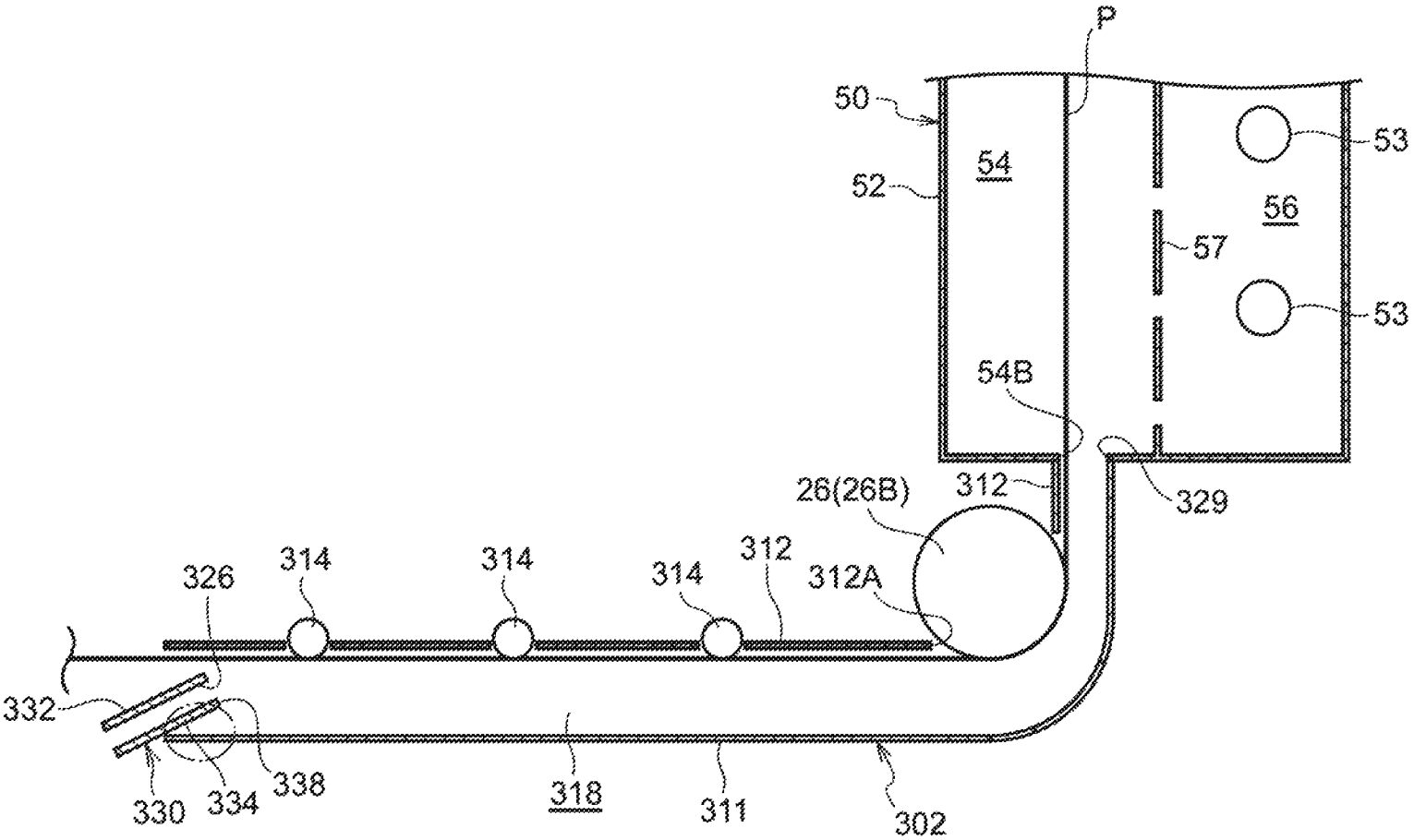
FIG. 12 is an enlarged schematic view illustrating a part of a configuration of an inkjet recording apparatus according to a comparative example.

In addition, the outer edge 338 of the air blowing port 326 on the upstream side in the feeding direction is disposed on the first opposed wall 311 side (lower side) with respect to the flow passageway 318. Here, in a configuration (twelfth comparative example) in which the outer edge 336 projects to the flow passageway 318, as shown in FIG. 12 and FIG. 13, an air vortex is generated in a corner part surrounded by the first opposed wall 311 and the lower wall portion 334 (the part of a space surrounded by the long dashed short dashed line in FIG. 12 and FIG. 13), resulting in a flow resistance of the air blown out from the air blowing port 326.

On the other hand, the outer edge 338 is disposed on the first opposed wall 311 side (lower side) with respect to the flow passageway 318. Thus, such an air vortex is hardly generated, so that the flow resistance of the air blown out from the air blowing port 326 is reduced in comparison with the twelfth comparative example.

Figure 13:
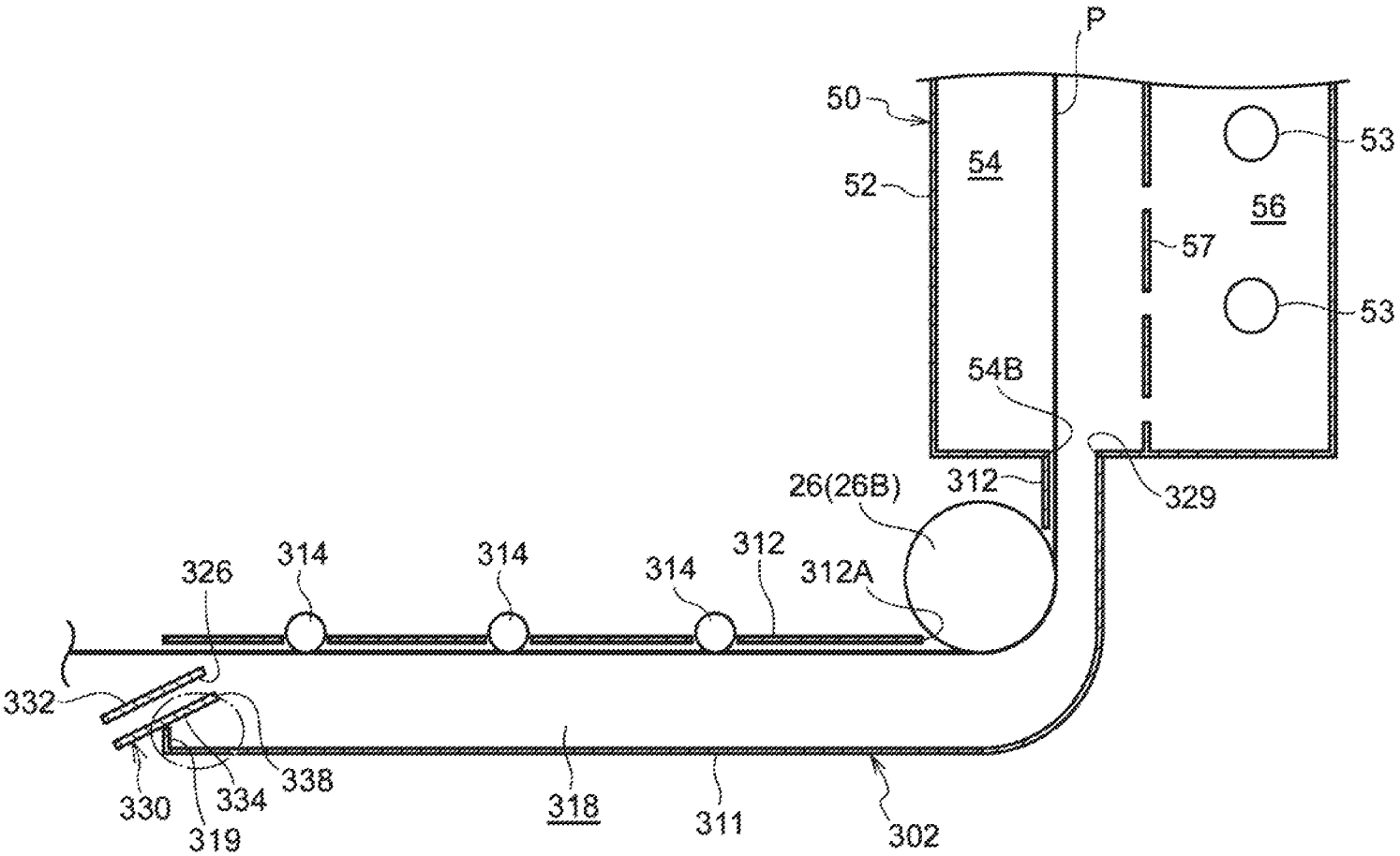
FIG. 13 is an enlarged schematic view illustrating a part of the configuration of the inkjet recording apparatus according to the comparative example.

Incidentally, in the configuration shown in FIG. 13, a projection wall 319 projecting upward from an end portion of the first opposed wall 311 on the downstream side in the feeding direction is formed. The lower wall portion 334 of the air blowing duct 330 is connected to an upper end of the projection wall 319.

Further, in the exemplary embodiment, the evaporation promoting chamber 302 includes the second opposed wall 312 that is disposed along the non-formation surface of the continuous paper P. Accordingly, the blown air is hardly released to the upper side of the continuous paper P. Thus, the volume of the air increases in comparison with a configuration (thirteenth comparative example) in which only the first opposed wall 311 is provided.

Figure 14:
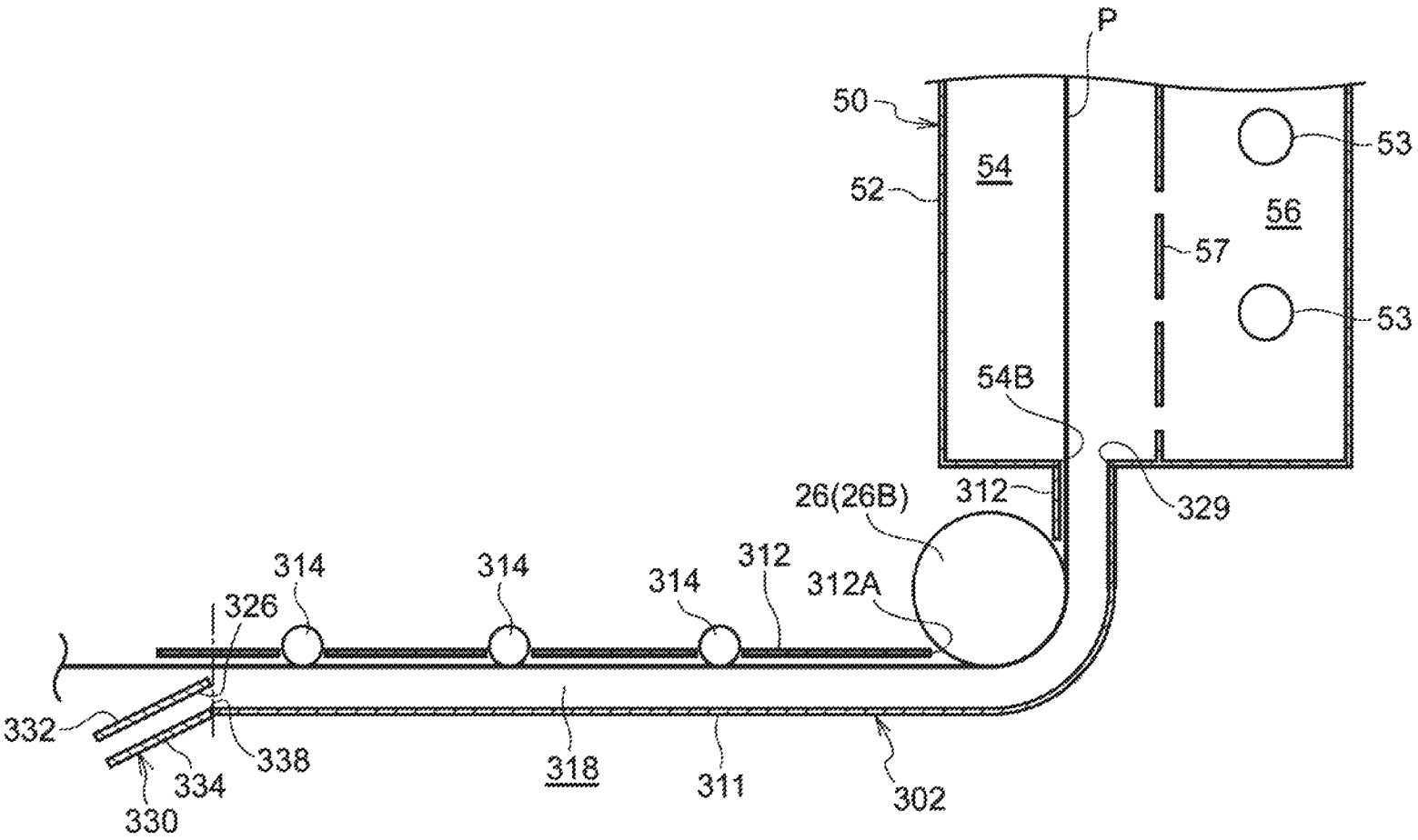
FIG. 14 is an enlarged schematic view illustrating a part of a configuration of an inkjet recording apparatus according to a modified example of the third exemplary embodiment.

The air blowing duct 330 according to the third exemplary embodiment may have a configuration in which a front end portion of the upper wall portion 332 extends above (just above) a front end portion of the lower wall portion 334 as shown in FIG. 14. In this configuration, the outer edge 338 does not serve as the outer edge of the air blowing port 326 on the upstream side in the feeding direction, but serves as the outer edge of the air blowing port 326 on the first opposed wall 311 side (the distant side from the continuous paper P).

Figure 15:
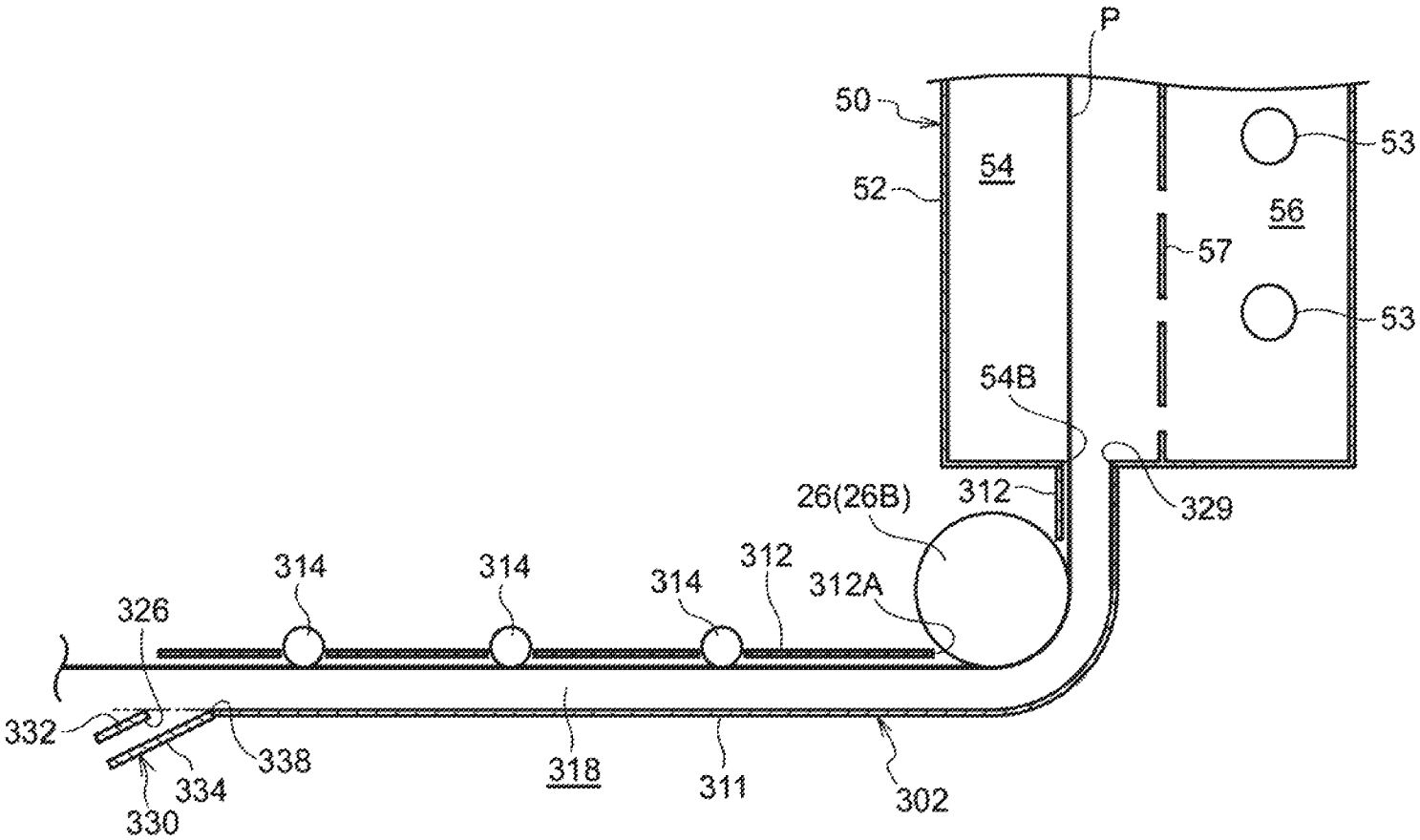
FIG. 15 is an enlarged schematic view illustrating the part of the configuration of the inkjet recording apparatus according to the modified example of the third exemplary embodiment.

In addition, the air blowing duct 330 according to the third exemplary embodiment may have a configuration in which the front end portion of the upper wall portion 332 is disposed at the same height (the same vertical position) as the front end portion of the lower wall portion 334 as shown in FIG. 15. In this configuration, the outer edge 338 does not serve as the outer edge of the air blowing port 326 on the first opposed wall 311 side (the distant side from the continuous paper P), but serves as the outer edge of the air blowing port 326 on the upstream side in the feeding direction.

First Modified Example of Third Exemplary Embodiment

Figure 16:
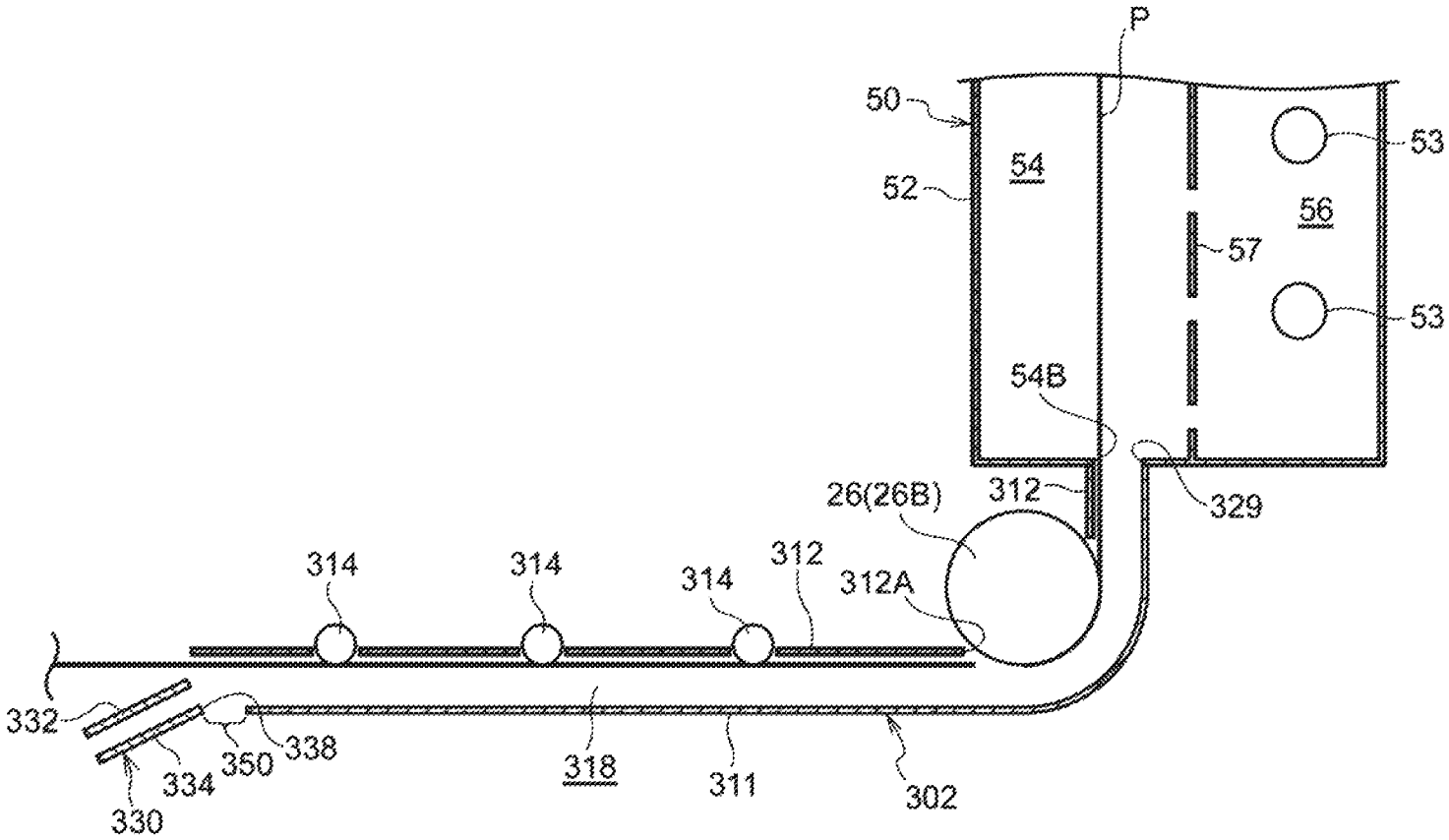
FIG. 16 is an enlarged schematic view illustrating a part of a configuration of an inkjet recording apparatus according to a first modified example of the third exemplary embodiment.

In another configuration, an opening portion 350 may be formed between the outer edge 338 and the first opposed wall 311 as shown in FIG. 16. The opening portion 350 is disposed on the upstream side in the feeding direction with respect to the outer edge 338. In addition, the opening portion 350 is formed into a rectangular shape having length in the widthwise direction of the continuous paper P. The length of the opening portion 350 in the widthwise direction of the continuous paper P is, for example, made as long as the length of the air blowing port 326 in the widthwise direction of the continuous paper P. The longitudinally opposite end portions of the opening portion 350 may be opened, or may be closed by the first opposed wall 311.

In the first modified example, when the air is blown out through the air blowing port 326, the air is introduced into the flow passageway 318 through the opening portion 350 due to the blown air. Accordingly, in the first modified example, the volume of the blown air flowing through the flow passageway 318 is increased in comparison with a configuration (fourteenth comparative example) in which the outer edge 338 and the first opposed wall 311 are connected without any gap.

Figure 17:
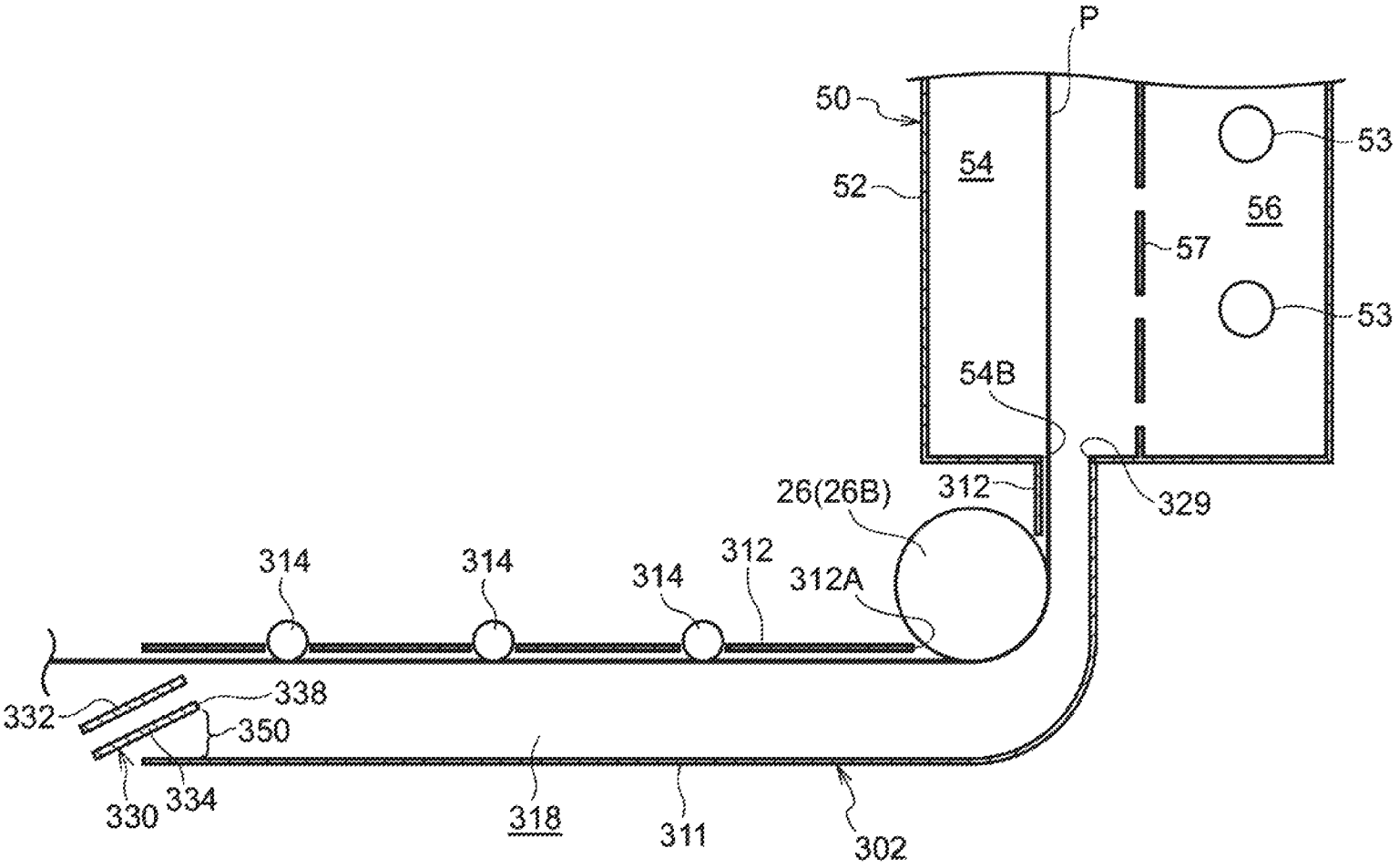
FIG. 17 is an enlarged schematic view illustrating the part of the configuration of the inkjet recording apparatus according to the first modified example of the third exemplary embodiment.

The opening portion 350 formed between the outer edge 338 and the first opposed wall 311 may have a configuration in which the opening portion 350 is formed on the lower side of the outer edge 338 (on the distant side from the continuous paper P or on the first opposed wall 311 side with respect to the continuous paper P) as shown in FIG. 17. Also in this configuration, the same operation as that in the configuration shown in FIG. 16 is implemented.

Second Modified Example of Third Exemplary Embodiment

Figure 18:
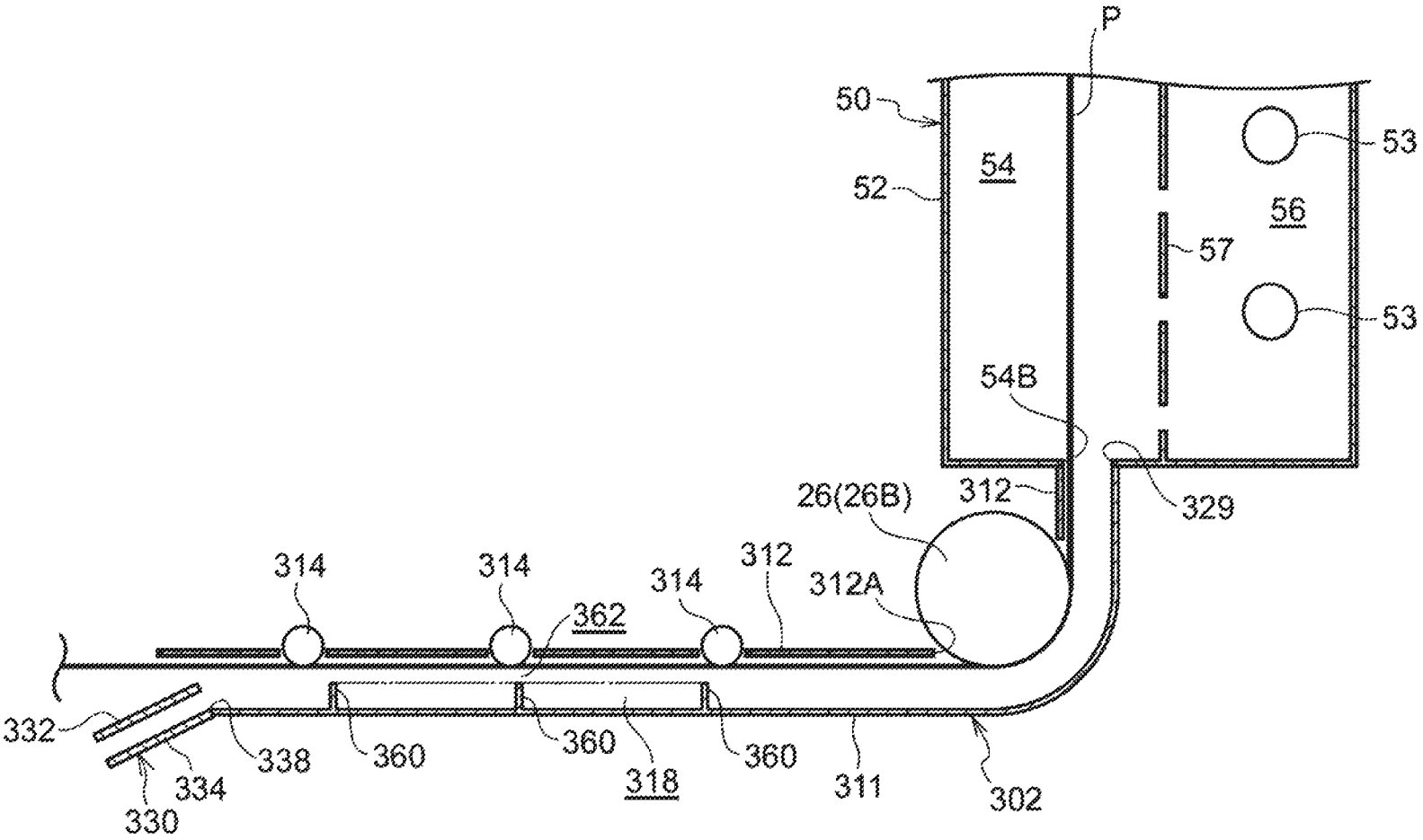
FIG. 18 is an enlarged schematic view illustrating a part of a configuration of an inkjet recording apparatus according to a second modified example of the third exemplary embodiment.

As shown in FIG. 18, the evaporation promoting chamber 302 has partition plates 360 each partitioning the flow passageway 318 into the upstream side in the feeding direction and the downstream side in the feeding direction. A plurality (specifically, three) of partition plates 36C are arranged in the feeding direction. Each partition plate 360 is provided to extend from the first opposed wall 311 toward the formation surface of the continuous paper P. Specifically, each partition plate 360 extends upward from the first opposed wall 311.

Each partition plate 360 has a gap between its upper end portion (end portion on the continuous paper P side) and the formation surface of the continuous paper P. Thus, an air flow passageway 362 along the formation surface of the continuous paper P is formed between upper end portions (end portions on the continuous paper P side) of the partition plates 360 and the formation surface. The air flow passageway 382 is formed as a passageway whose length in the up/down direction is made shorter than the aforementioned flow passageway 318 so that the blown air flows (passes) through the air flow passageway 362.

In the second modified example, the length of the air flow passageway 362 in the up/down direction is shortened to increase the velocity of the blown air, in comparison with a configuration (fifteenth comparative example) in which an air flow passageway (corresponding to the flow passageway 318) is formed along the formation surface of the continuous paper P by only the first opposed wall 311.

In addition, in the second modified example, the first opposed wall 311 is not made closer to the continuous paper P in order to shorten the length of the air flow passageway in the up/down direction, but the partition plates 360 are spaced from each other. Accordingly, the volume of the space between the first opposed wall 311 and the formation surface of the continuous paper P is secured. Thus, in the second modified example, it is possible to increase the velocity of the blown air while suppressing increase of humidity in the space between the first opposed wall 311 and the formation surface of the continuous paper P, in comparison with the fifteenth comparative example.

In addition, in the second modified example, each partition plate 360 is disposed in a position closer to the air blowing port 326 than a discharge port 329 from which the air flowing through the space (flow passageway 318) between the first opposed wall 311 and the formation surface of the continuous paper P is discharged.

Accordingly, the air flow passageway 362 whose length in the up/down direction is shorter than the flow passageway 318 is formed in a position close to the air blowing port 326, in comparison with a configuration (sixteenth comparative example) in which each partition plate 360 is disposed in a position closer to the discharge port 329 than the air blowing port 326. Thus, the velocity of the blown air is increased in comparison with the sixteenth comparative example.

Figure 19:
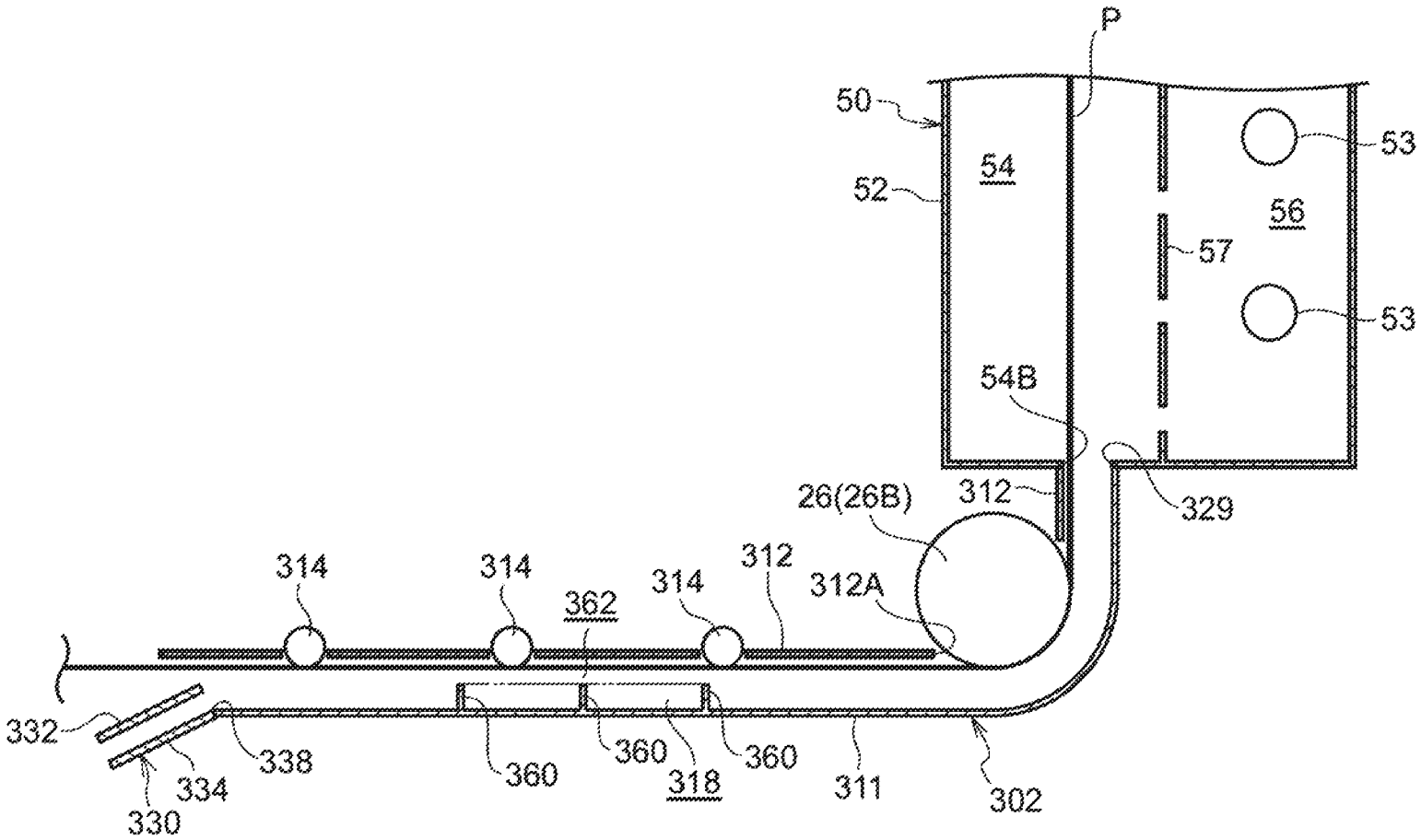
FIG. 19 is an enlarged schematic view illustrating the part of the configuration of the inkjet recording apparatus according to the second modified example of the third exemplary embodiment.
Figure 20:
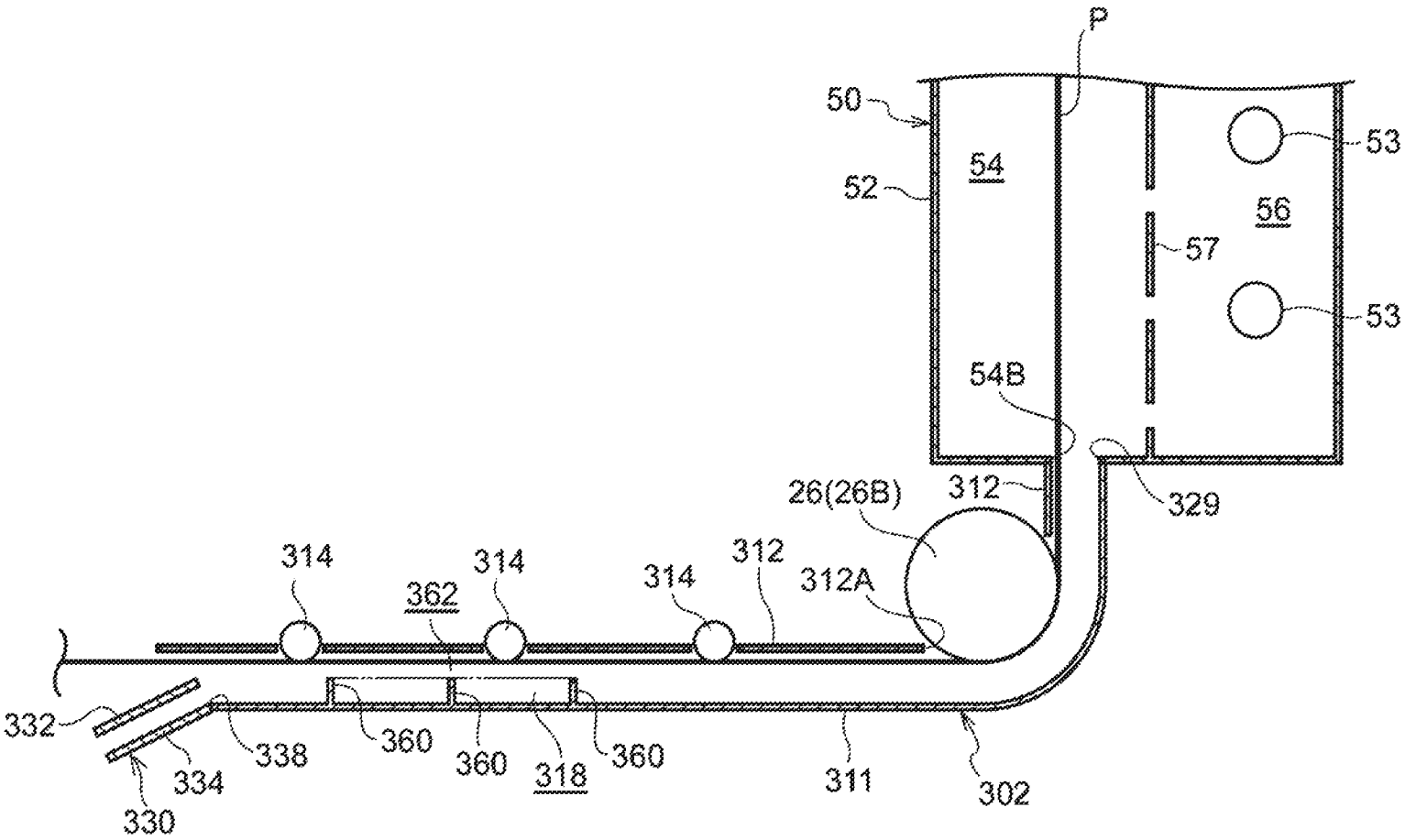
FIG. 20 is an enlarged schematic view illustrating the part of the configuration of the inkjet recording apparatus according to the second modified example of the third exemplary embodiment.

That is, the effect of increasing the velocity of the blown air flowing through the air flow passageway 362 is higher in a configuration (see FIG. 20) in which the partition plates 360 are kept close to the air blowing port 326 than in a configuration (see FIG. 19) in which the partition plates 360 are kept away from the air flow port 326. Therefore, in a desired configuration, the partition plates 360 are kept close to the air blowing port 326.

Figure 21:
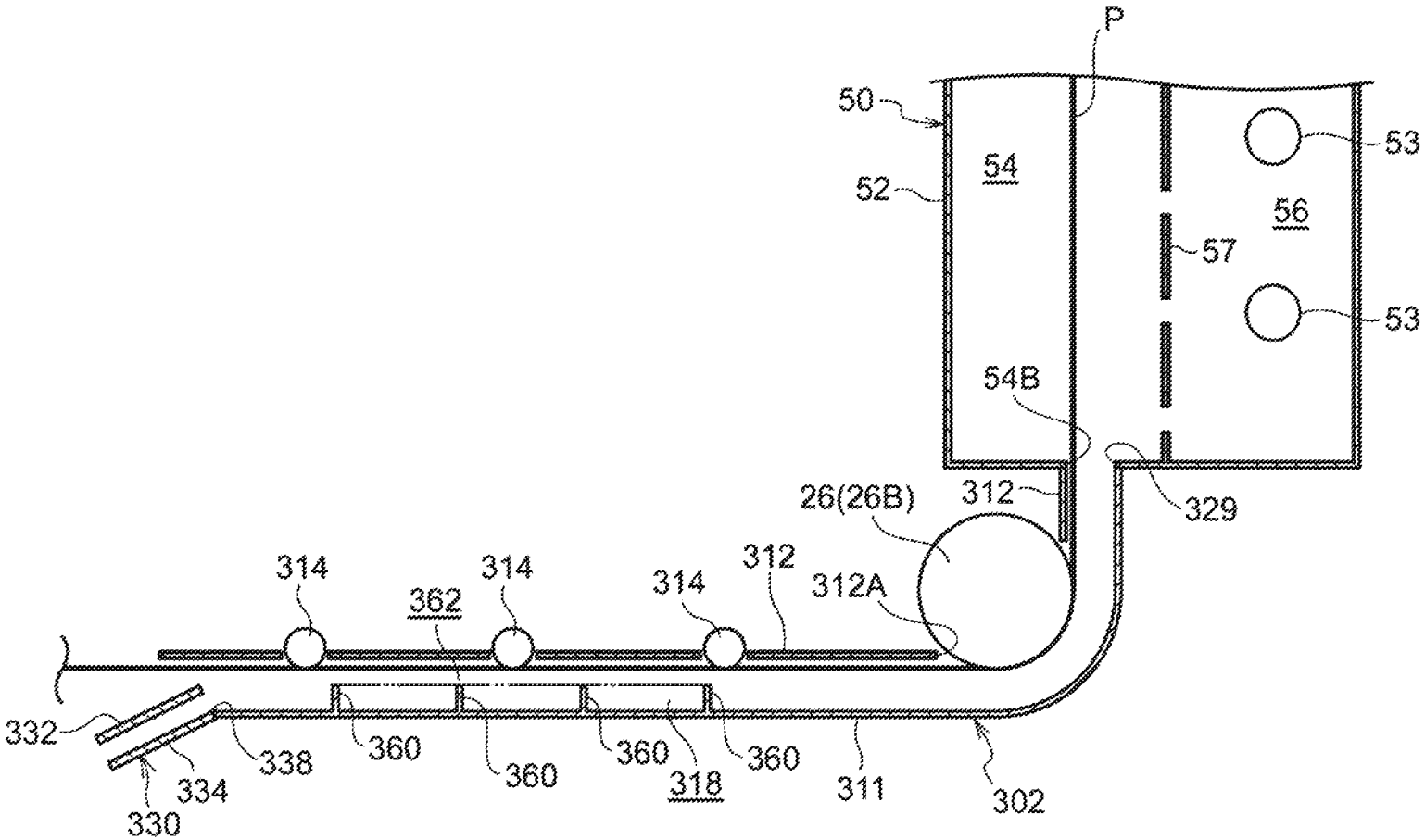
FIG. 21 is an enlarged schematic view illustrating the part of the configuration of the inkjet recording apparatus according to the second modified example of the third exemplary embodiment.

In another configuration, the number of partition plates 360 may be increased to four to narrow the intervals among the partition plates 360, as shown in FIG. 21. In this configuration, the velocity of the air flowing through the air flow passageway 362 is increased. When the number of partition plates 360 is increased, the space between the first opposed wall 311 and the formation surface of the continuous paper P is narrowed to increase the humidity. Therefore, it is desired to increase the number of partition plates 360 within the extent in which the humidity required for drying the continuous paper P can be kept.

Further, the partition plates 360 may be disposed along the air blowing direction (toward the obliquely right upper of FIG. 22) of the air blowing port 326 and obliquely to the formation surface of the continuous paper P. In the configuration shown in FIG. 22, each partition plate 360 extends from the first opposed wall 311 toward the obliquely right upper of FIG. 22.

Figure 22:
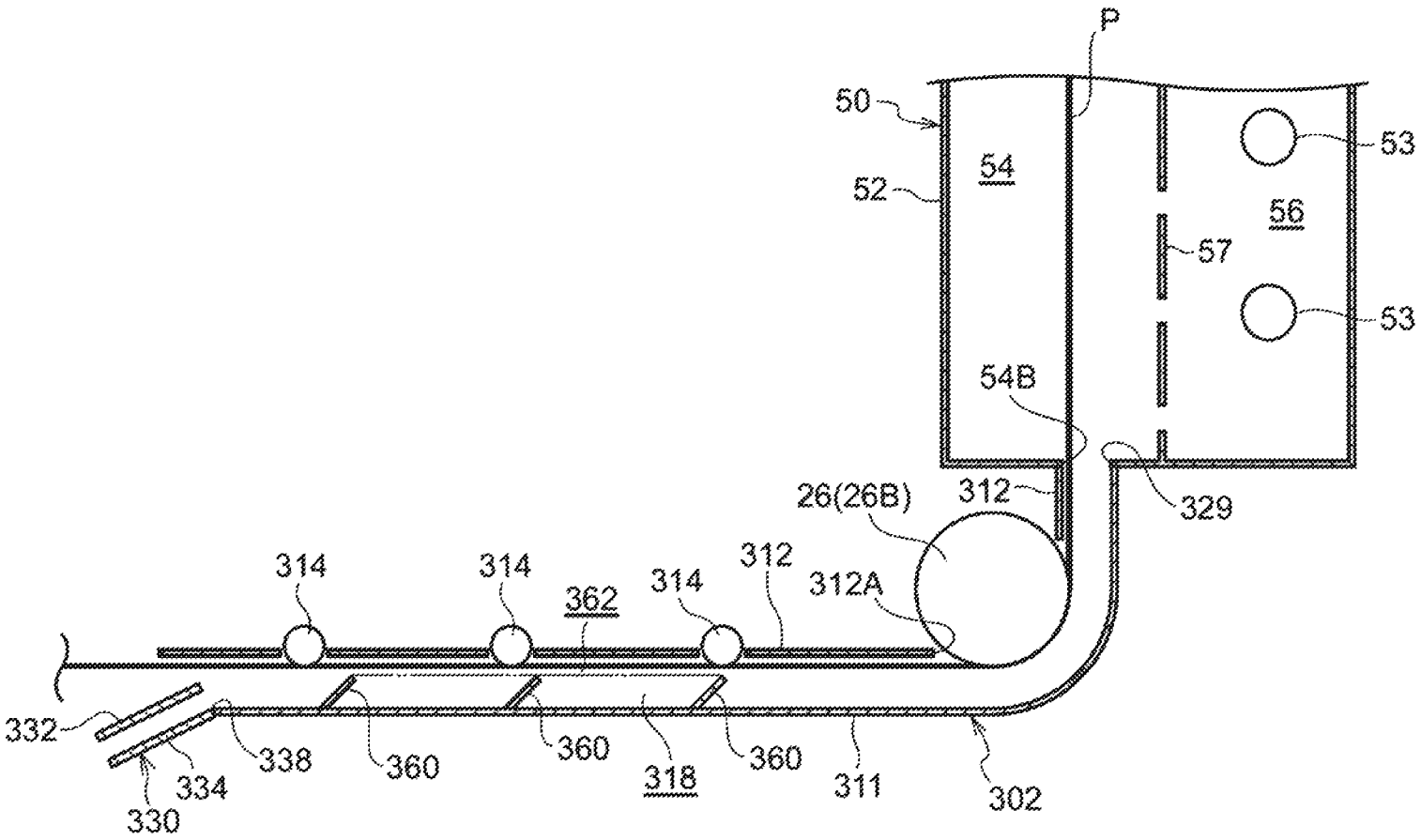
FIG. 22 is an enlarged schematic view illustrating the part of the configuration of the inkjet recording apparatus according to the second modified example of the third exemplary embodiment.

According to the configuration shown in FIG. 22, the flow resistance of the blown air is reduced in comparison with a configuration in which the partition plates 360 are disposed along a direction crossing the air blowing direction (toward the obliquely right upper of FIG. 22) of the air blowing port and obliquely to the formation surface of the continuous paper P.

Figure 23:
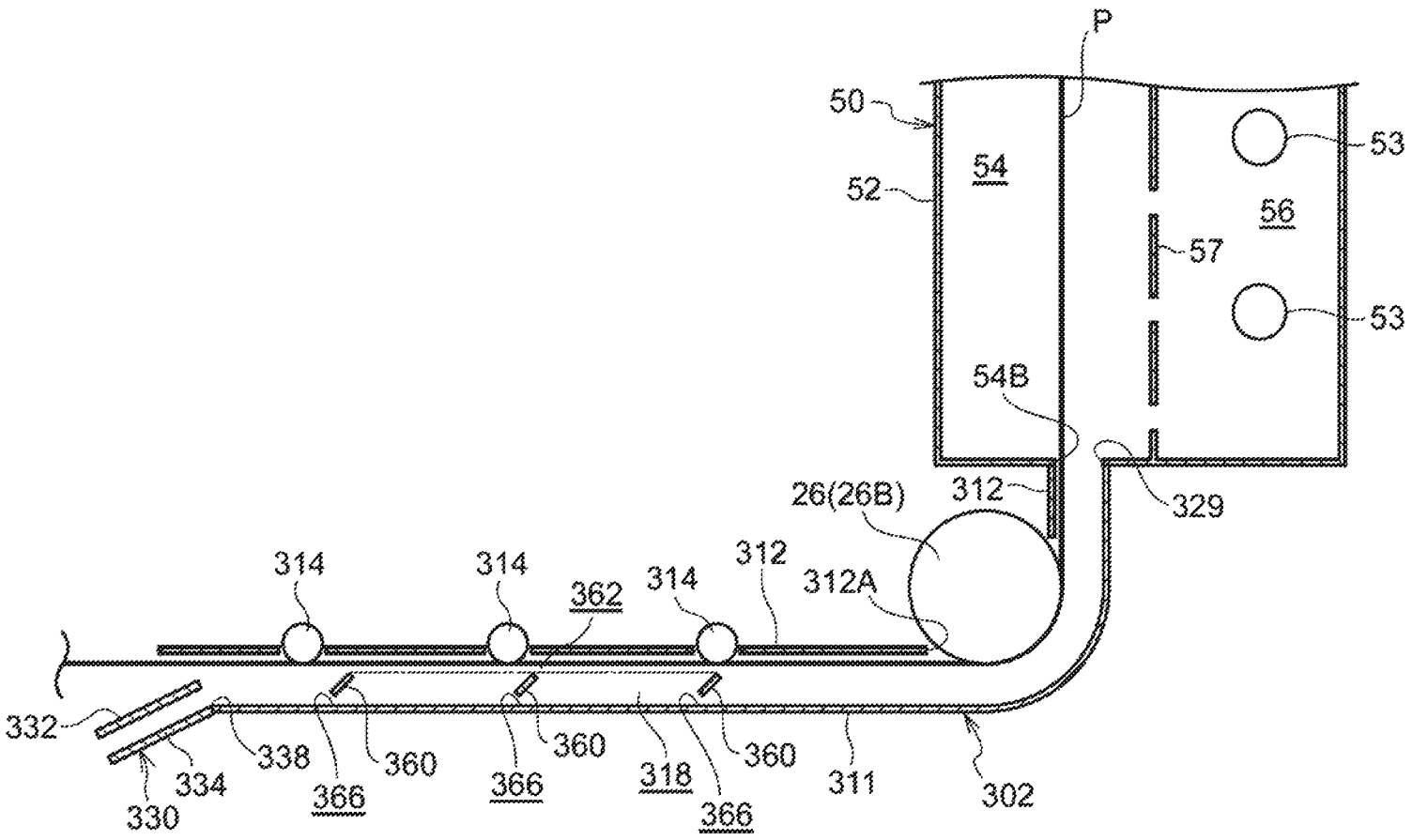
FIG. 23 is an enlarged schematic view illustrating the part of the configuration of the inkjet recording apparatus according to the second modified example of the third exemplary embodiment.

In another configuration, a gap 366 may be formed between each partition plate 360 and the first opposed wall 311 as shown in FIG. 23.

According to the configuration shown in FIG. 23, due to the gap 366, the air circulates between spaces partitioned by the partition plate 360, that is, the space partitioned on the upstream side in the feeding direction and the space partitioned on the downstream in the feeding direction. Thus, increase of humidity in the space between the first opposed wall 311 and the continuous paper P is suppressed in comparison with the configuration where the partition plate 360 and the first opposed wall 311 are connected without any gap.

Other Modified Examples of Third Exemplary Embodiment

Although the air blowing port 326 blows the air obliquely to the formation surface of the continuous paper P and toward the upstream side in the feeding direction of the continuous paper P in the third exemplary embodiment, the air blowing port 326 is not limited thereto. In another configuration, the air blowing port 326 may blow the air obliquely to the formation surface of the continuous paper P and toward the downstream side in the feeding direction of the continuous paper P.

In addition, although the velocity of the air blown by the air blower 306 can be changed in accordance with the feeding rate of the continuous paper P in the third exemplary embodiment, the velocity of the air blown by the air blower 306 is not limited thereto. In another configuration, the velocity of the air blown by the air blower 306 may be fixed.

Further, the evaporation promoting chamber 302 may be disposed in the feeding path between the first drying portion 50 and the second drying portion 60. The outlet 54B of the first drying portion 50 does not have to be connected to the first opposed wall.

The present invention is not limited to the aforementioned exemplary embodiments, but various changes, modifications or improvements can be made on the invention without departing from the gist thereof. For example, a plurality of the aforementioned modified examples may be combined and arranged suitably.

What is claimed is:

1. An ejection device comprising:

an ejection portion that ejects liquid droplets onto one surface of a recording medium that is fed;

a first drying portion that applies light energy to the one surface in a noncontact manner to thereby dry the liquid droplets;

a second drying portion that comes in contact with only an other surface of the recording medium in which the liquid droplets have been dried by the first drying portion, and heats the recording medium to thereby dry the recording medium; and a promotion chamber that is disposed in the path between the first drying portion and the second drying portion so as to promote evaporation of moisture of the liquid droplets, the promotion chamber including an opposed wall that is disposed along the one surface and opposed to the one surface, and an air blowing port that blows air from the opposed wall side toward an upstream side in a feeding direction of the recording medium and obliquely to the one surface, wherein air is blown along the one surface in the promotion chamber.

2. The ejection device according to claim 1, wherein:

the first drying portion irradiates the one surface with light of a wavelength in which an absorption rate in the liquid droplets is higher than an absorption rate in the recording medium.

3. The ejection device according to claim 2, wherein:

in a path between the first drying portion and the second drying portion, no contact member comes in contact with the one surface of the recording medium.

4. The ejection device according to claim 1, wherein:

in a path between the first drying portion and the second drying portion, no contact member comes in contact with the one surface of the recording medium.

5. The ejection device according to claim 4, wherein:

only a contact member that comes in contact with the recording medium through the other surface is disposed in the path between the first drying portion and the second drying portion.

6. The ejection device according to claim 1, wherein:

at least one of the first drying portion and the second drying portion comprises an air blower that blows air to the recording medium; and air is blown along the one surface in the promotion chamber by the air blower.

7. The ejection device according to claim 6, wherein:

velocity of the air blown to the promotion chamber is changed in accordance with a feeding rate of the recording medium.

8. The ejection device according to claim 1, wherein:

velocity of the air blown to the promotion chamber is changed in accordance with a feeding rate of the recording medium.

9. The ejection device according to claim 1, wherein:

an outer edge of the air blowing port on the upstream side in the feeding direction or on the opposed wall side is disposed on the opposed wall side with respect to a space between the opposed wall and the one surface.

10. The ejection device according to claim 9, wherein:

an opening portion is formed between the opposed wall and the outer edge of the air blowing port on the upstream side in the feeding direction or on the opposed wall side.

11. The ejection device according to claim 1, wherein:

an opening portion is formed between the opposed wall and the outer edge of the air blowing port on the upstream side in the feeding direction or on the opposed wall side.

12. The ejection device according to claim 1, wherein the promotion chamber comprises:

partition plates that are provided to extend from the opposed wall side toward the one surface, so that each of the partition plates partitions the space between the opposed wall and the one surface into an upstream part and a downstream part in the feeding direction and form an air flow path between an end portion of the partition plate on the one surface side and the one surface and along the one surface.

13. The ejection device according to claim 12, wherein:

the partition plates are disposed along an air blowing direction of the air blowing port and obliquely to the one surface.

14. The ejection device according to claim 13, wherein:

a gap is provided between each of the partition plates and the opposed wall.

15. The ejection device according to claim 12, wherein:

a gap is provided between each of the partition plates and the opposed wall.

16. The ejection device according to claim 12, wherein:

the promotion chamber comprises a discharge port through which the air flowing through a space between the opposed wall and the one surface is discharged from the space; and the partition plates are disposed in positions closer to the air blowing port than the discharge port.

17. The ejection device according to claim 1, wherein:

the promotion chamber comprises a wall portion disposed along the other surface.

* * * * *